US012523117B2

(12) United States Patent
Steele

(10) Patent No.: US 12,523,117 B2
(45) Date of Patent: Jan. 13, 2026

(54) ROD PUMP WITH NON-LOCKING ACTUATOR

(71) Applicant: Geoff Steele, Calgary (CA)

(72) Inventor: Geoff Steele, Calgary (CA)

(73) Assignee: Vantage Production Tools Inc., Calgary (CA)

( * ) Notice: Subject to any disclaimer, the term of this patent is extended or adjusted under 35 U.S.C. 154(b) by 25 days.

(21) Appl. No.: 18/594,750

(22) Filed: Mar. 4, 2024

(65) Prior Publication Data

US 2024/0328282 A1 Oct. 3, 2024

Related U.S. Application Data

(60) Provisional application No. 63/488,148, filed on Mar. 2, 2023.

(51) Int. Cl.

| | |
|---|---|
| ***E21B 34/08*** | (2006.01) |
| ***E21B 43/12*** | (2006.01) |
| ***E21B 43/38*** | (2006.01) |
| ***F04B 19/22*** | (2006.01) |
| ***F04B 47/00*** | (2006.01) |
| ***F04B 53/10*** | (2006.01) |

(52) U.S. Cl.

CPC ..... *E21B 34/08* (2013.01); *E21B 43/12* (2013.01); *E21B 43/121* (2013.01); *E21B 43/126* (2013.01); *E21B 43/38* (2013.01); *F04B 19/22* (2013.01); *F04B 47/00* (2013.01); *F04B 53/10* (2013.01)

(58) Field of Classification Search

CPC ..... E21B 34/08; E21B 43/12; E21B 43/121; E21B 43/126; E21B 43/38; F04B 19/22; F04B 47/00; F04B 53/10

See application file for complete search history.

(56) References Cited

U.S. PATENT DOCUMENTS

| | | | |
|---|---|---|---|
| 913,123 | A | 2/1909 | Gleason |
| 1,066,798 | A | 7/1913 | Conrader |
| 2,010,587 | A | 8/1935 | Fisher et al. |
| 2,344,786 | A | 3/1944 | Patterson et al. |
| 3,020,852 | A | 2/1962 | Roach et al. |

(Continued)

FOREIGN PATENT DOCUMENTS

| | | | |
|---|---|---|---|
| CA | 1058993 | A | 7/1979 |
| CA | 2520944 | C | 3/2010 |

(Continued)

OTHER PUBLICATIONS

Baird Valve and Regulator, LLC, Positive Lift Traveling Valve, web catalog, retrieved Sep. 16, 2024.

(Continued)

*Primary Examiner* — Hoang M Nguyen

(74) *Attorney, Agent, or Firm* — Bennett Jones LLP

(57) ABSTRACT

A rod pump system is configured to provide efficient pumping operations in a downhole environment containing high gas content, using a non-locking actuator. The non-locking actuator assembly is configured to respond to high-gas conditions and automatically overcome a gas locked pump state thereby returning the system to normal pumping conditions. This system is appended to the traveling valve closed cage within a conventional rod pump in place of a conventional seat plug.

17 Claims, 12 Drawing Sheets

(56) References Cited

U.S. PATENT DOCUMENTS

| | | | |
|---|---|---|---|
| 3,062,153 | A | 11/1962 | Losey |
| 3,861,471 | A | 1/1975 | Douglas |
| 4,050,854 | A | 9/1977 | Hereford et al. |
| 4,219,311 | A | 8/1980 | Simon |
| 4,257,751 | A | 3/1981 | Kofahl |
| 4,329,124 | A | 5/1982 | Pridy |
| 4,360,320 | A | 11/1982 | Owen |
| 4,439,113 | A | 3/1984 | Owen |
| 4,580,952 | A | 4/1986 | Eberle |
| 4,653,989 | A | 3/1987 | Mason |
| 4,691,735 | A | 9/1987 | Horton |
| 4,813,485 | A | 3/1989 | Coyle |
| 4,880,062 | A | 11/1989 | Bland et al. |
| 4,907,953 | A | 3/1990 | Hebert et al. |
| 4,923,372 | A | 5/1990 | Ferguson et al. |
| 5,117,861 | A | 6/1992 | McConnell et al. |
| 5,141,411 | A | 8/1992 | Klaeger |
| 5,154,532 | A | 10/1992 | Schaefer et al. |
| 5,207,096 | A | 5/1993 | Castel et al. |
| 5,249,936 | A | 10/1993 | McConnell et al. |
| 5,253,713 | A | 10/1993 | Gregg et al. |
| 5,271,725 | A | 12/1993 | Freet et al. |
| 5,297,579 | A | 3/1994 | McConnell |
| 5,372,488 | A | 12/1994 | Turner |
| 5,407,333 | A | 4/1995 | Lambright |
| 5,427,504 | A | 6/1995 | Dinning et al. |
| 5,445,356 | A | 8/1995 | Walsh |
| 5,447,201 | A | 9/1995 | Mohn |
| 5,522,463 | A | 6/1996 | Barbee |
| 5,752,814 | A | 5/1998 | Starks et al. |
| 5,829,952 | A | 11/1998 | Shadden |
| 5,842,839 | A | 12/1998 | Walsh et al. |
| 6,045,335 | A | 4/2000 | Dinning |
| 6,119,780 | A | 9/2000 | Christmas |
| 6,273,690 | B1 | 8/2001 | Fischer et al. |
| 6,435,838 | B1 | 8/2002 | Marvel et al. |
| 6,554,580 | B1 | 4/2003 | Mayfield et al. |
| 6,558,128 | B2 | 5/2003 | Marvel et al. |
| 6,619,402 | B1 | 9/2003 | Amory et al. |
| 6,644,399 | B2 | 11/2003 | Abbott et al. |
| 6,725,916 | B2 | 4/2004 | Gray et al. |
| 6,810,961 | B2 | 11/2004 | Marvel et al. |
| 6,915,856 | B2 | 7/2005 | Gentry et al. |
| 6,973,973 | B2 | 12/2005 | Howard et al. |
| 7,108,059 | B1 | 9/2006 | Lanier |
| 7,252,148 | B2 | 8/2007 | Traylor |
| 7,270,178 | B2 | 9/2007 | Selph |
| 7,347,273 | B2 | 3/2008 | George et al. |
| 7,458,787 | B2 | 12/2008 | Brown |
| 7,753,115 | B2 | 7/2010 | Zupanick |
| 8,347,954 | B2 | 1/2013 | Amies et al. |
| 8,708,050 | B2 | 4/2014 | Dykstra et al. |
| 9,863,414 | B2 | 1/2018 | Laing et al. |
| 10,329,886 | B2 * | 6/2019 | Steele ..... F04B 47/00 |
| 10,443,590 | B1 * | 10/2019 | McCoy ..... F15B 15/1461 |
| 11,746,631 | B2 | 9/2023 | Laing et al. |
| 2003/0215337 | A1 | 11/2003 | Lee |
| 2005/0047926 | A1 | 3/2005 | Butler et al. |
| 2005/0211444 | A1 | 9/2005 | Kauffman et al. |
| 2007/0022874 | A1 | 2/2007 | Townsend |
| 2008/0112826 | A1 | 5/2008 | Ford |
| 2008/0185141 | A1 * | 8/2008 | Amies ..... E21B 43/121 166/105 |
| 2011/0114305 | A1 | 5/2011 | Roberts et al. |
| 2011/0209879 | A1 | 9/2011 | Quigley et al. |
| 2012/0012333 | A1 | 1/2012 | Quigley et al. |
| 2012/0048782 | A1 | 3/2012 | Wu et al. |
| 2012/0080196 | A1 | 4/2012 | Laing et al. |
| 2013/0037261 | A1 | 2/2013 | Duphorne |
| 2014/0341755 | A1 | 11/2014 | Laing et al. |
| 2016/0177666 | A1 | 6/2016 | Van Dam et al. |
| 2017/0191356 | A1 | 7/2017 | Steele et al. |
| 2018/0087495 | A1 | 3/2018 | Laing et al. |
| 2018/0283146 | A1 | 10/2018 | Stachowiak, Jr. |
| 2019/0376600 | A1 | 12/2019 | Ford |
| 2021/0010354 | A1 | 1/2021 | Laing et al. |
| 2021/0270257 | A1 * | 9/2021 | McCarthy ..... F04B 9/113 |

FOREIGN PATENT DOCUMENTS

| | | | |
|---|---|---|---|
| CA | 2644346 | A1 | 5/2010 |
| CA | 2754242 | A1 | 3/2012 |
| CA | 2583041 | C | 4/2015 |
| CA | 2885571 | A1 | 5/2015 |
| CA | 2687189 | A1 | 8/2015 |
| CA | 2953157 | A1 | 12/2015 |
| CA | 3045343 | A1 | 12/2019 |
| CA | 3063767 | A1 | 2/2020 |
| CN | 107869312 | A | 4/2018 |
| RU | 2225938 | C1 | 3/2004 |
| RU | 2382180 | C1 | 2/2010 |
| RU | 94628 | U1 | 5/2010 |
| WO | 8201738 | A1 | 5/1982 |
| WO | 2006032145 | A1 | 3/2006 |
| WO | 2013086623 | A1 | 6/2013 |
| WO | 2015196287 | A1 | 12/2015 |
| WO | 2016120267 | A1 | 8/2016 |
| WO | 2019173910 | A1 | 9/2019 |
| WO | 2021035332 | A1 | 3/2021 |

OTHER PUBLICATIONS

Baird Valve and Regulator, LLC, Products, web catalog, retrieved Sep. 16, 2024.

* cited by examiner

PRIOR ART (FLUIDIC ENVIRONMENT)

(GASEOUS ENVIRONMENT)

401
600
301
320
410
30
402
303
1
60
403
404
100
310
GG
DETAIL GG
SCALE 1 : 3

401
700
402
301
320
403
404
HH
303
310
DETAIL HH
SCALE 1 : 3

JJ
60
DETAIL JJ
SCALE 2 : 3

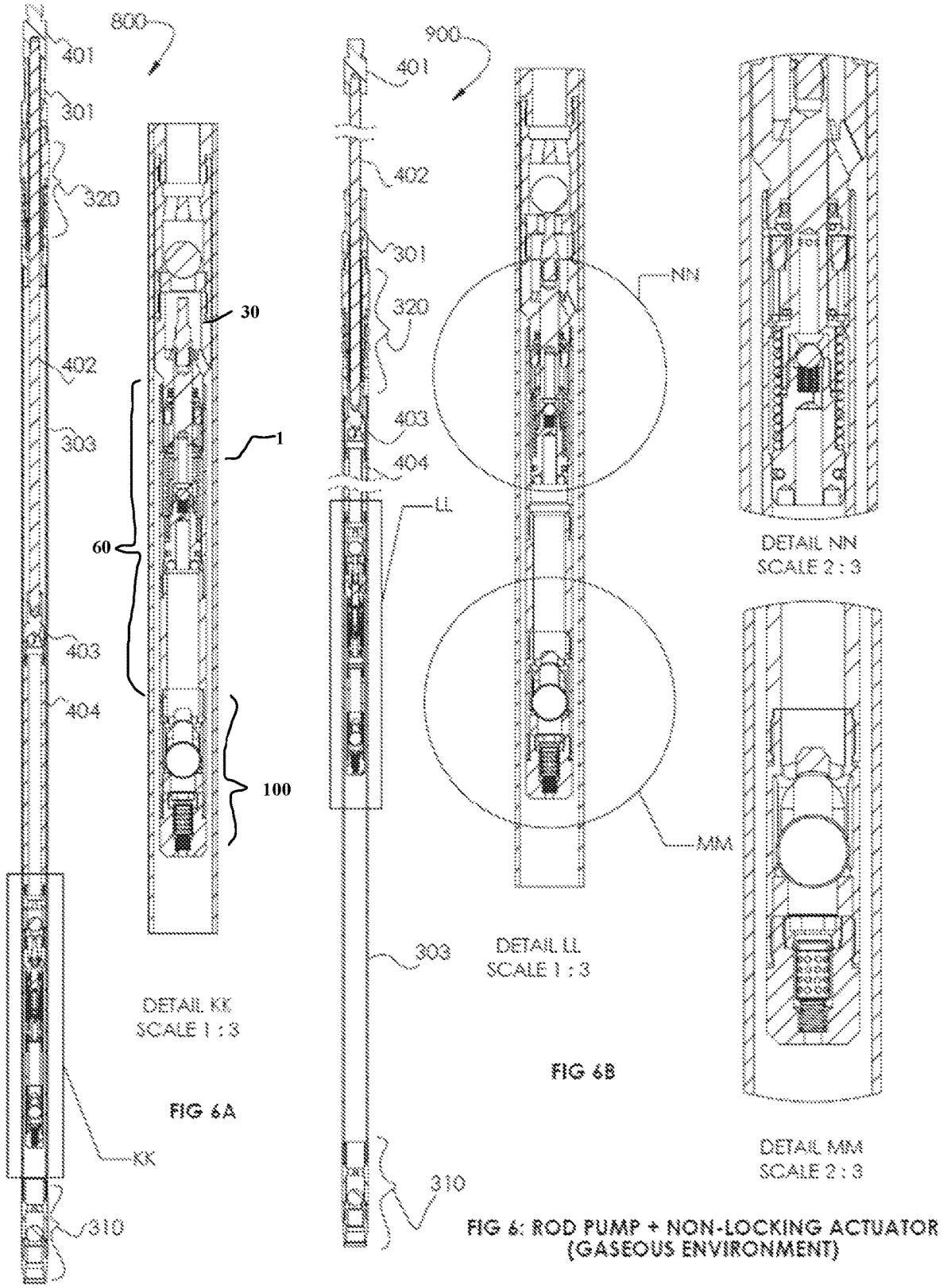
FIG 6: ROD PUMP + NON-LOCKING ACTUATOR (GASEOUS ENVIRONMENT)

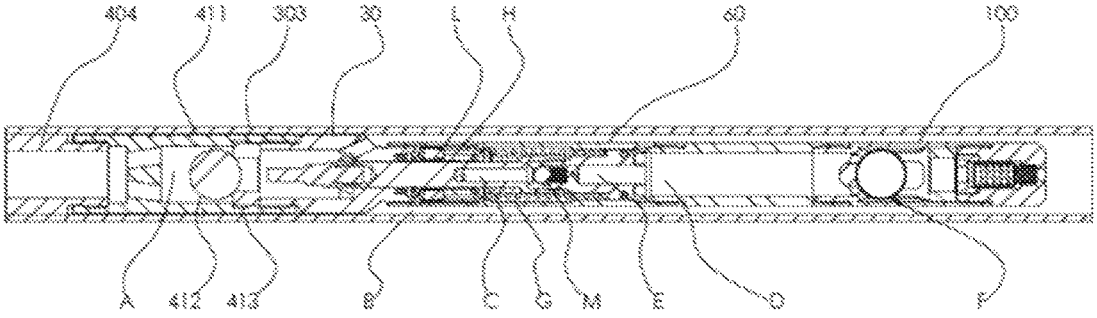
PROXIMAL END
FIGURE 7A: Pumping State
CROPPED VIEW
SCALE 1 : 2
DISTAL END
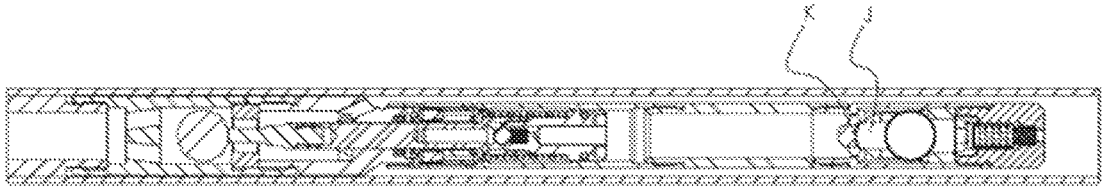
FIGURE 7B: Pumping State
CROPPED VIEW
SCALE 1:2
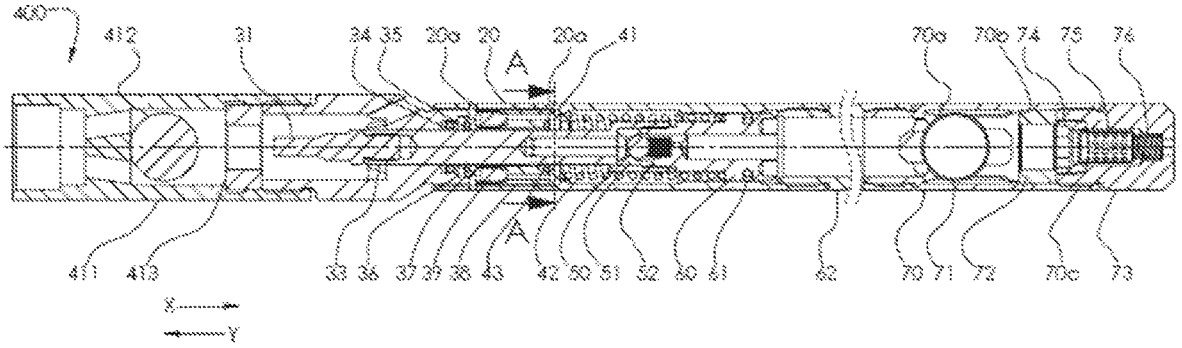
PROXIMAL END
FIGURE 8
DISTAL END
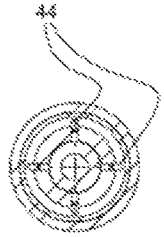
SECTION A-A
SCALE 1 : 1

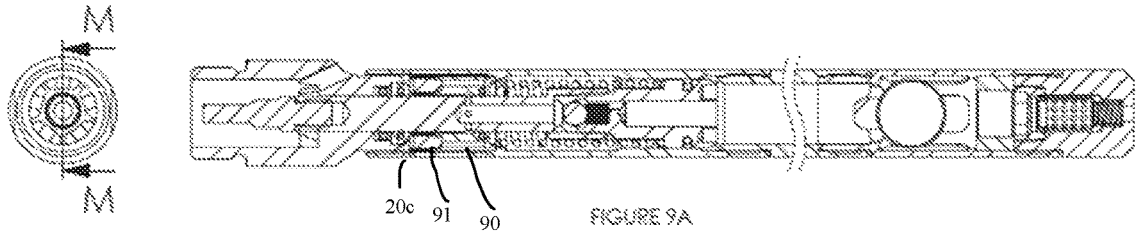
FIGURE 9A
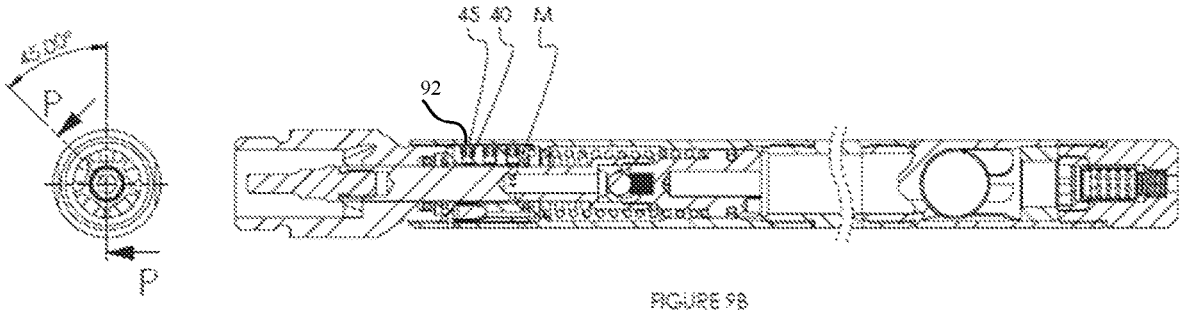
FIGURE 9B
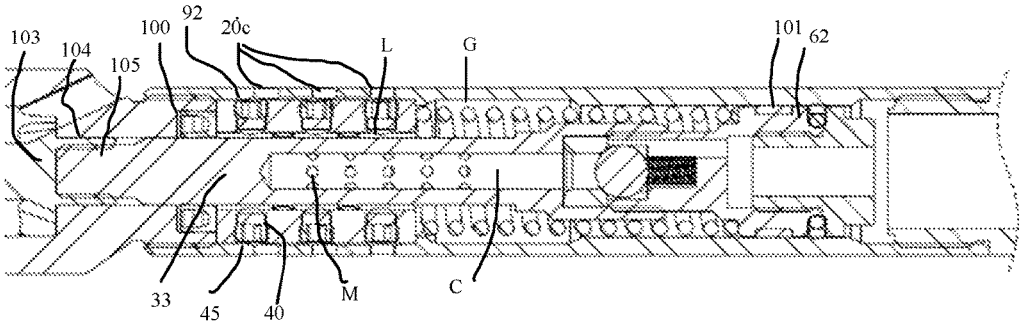
FIG 9C
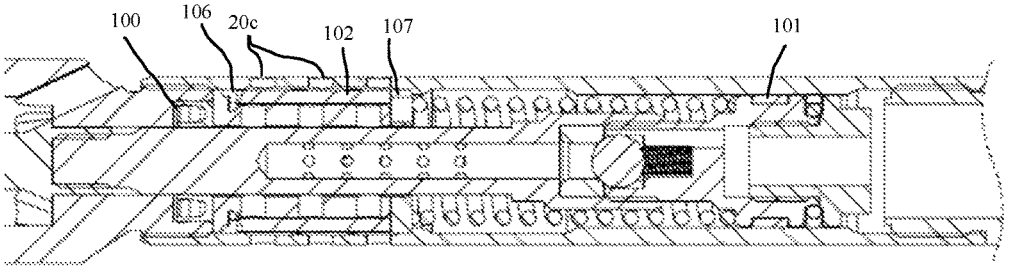
FIG 9D

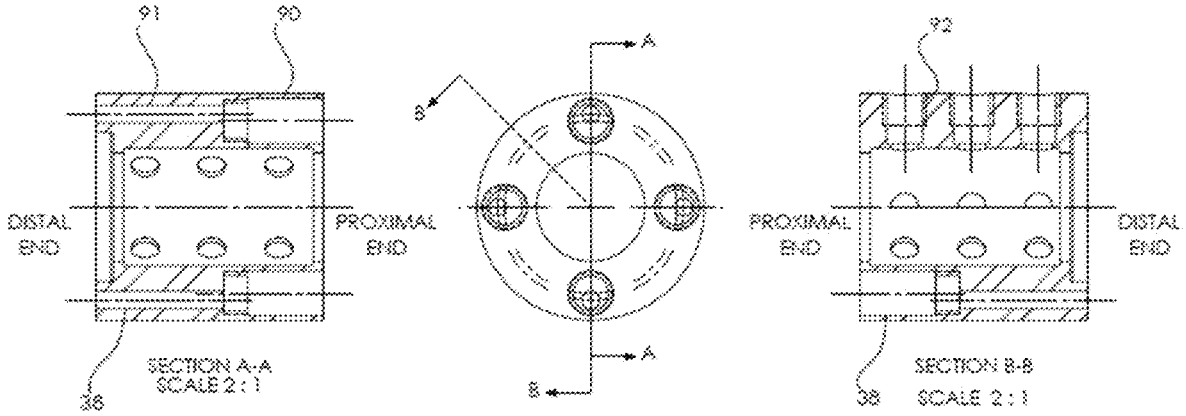
FIGURE 10B
FIGURE 10A
PROXIMAL END VIEW
FIGURE 10C
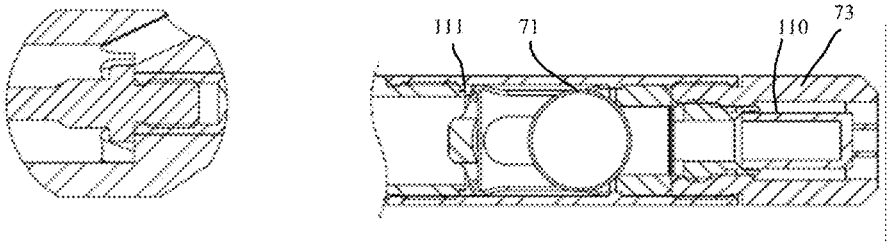
FIGURE 11D
SCALE 2 : 1.5
FIGURE 11E
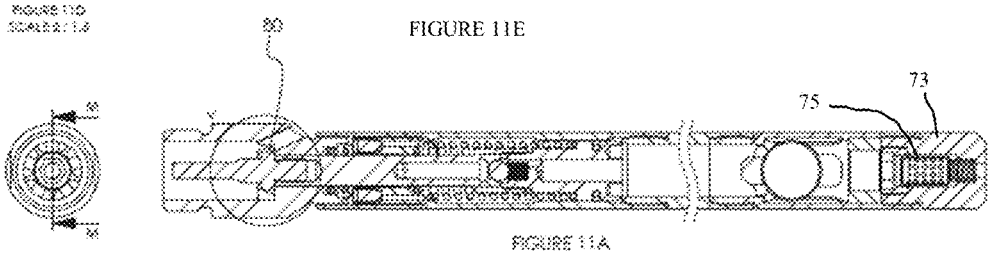
FIGURE 11A
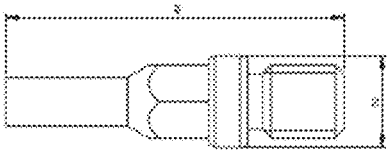
FIGURE 11B
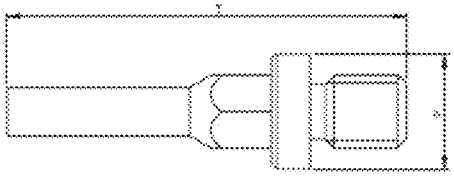
FIGURE 11C Figure 18A: Pressure Cycle Graph No-Lock Pump
Gaseous Environment
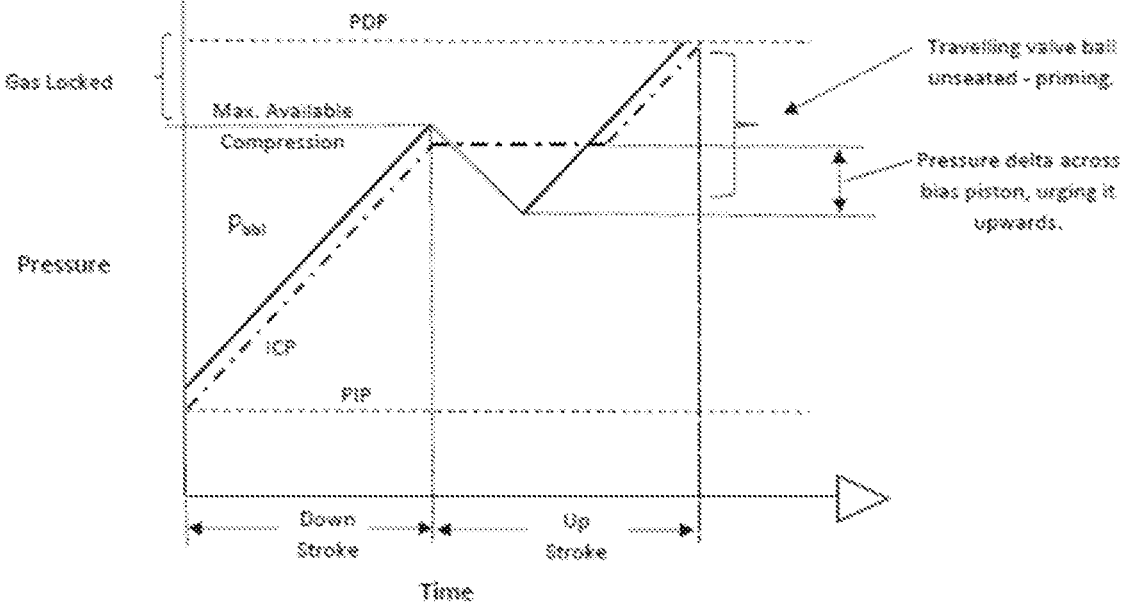
Figure 18B: Pressure Cycle Graph – No-Lock Pump
Fluidic Environment
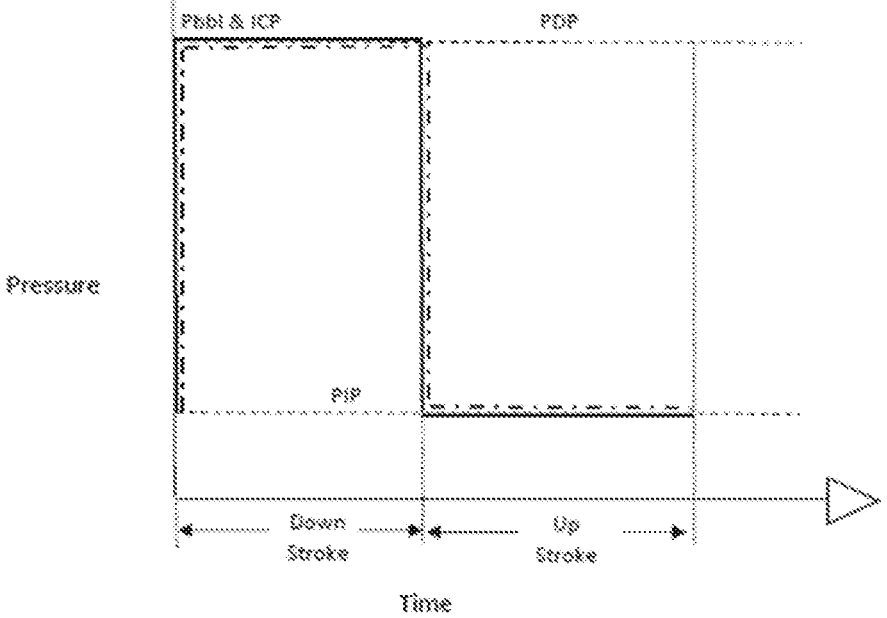

ROD PUMP WITH NON-LOCKING ACTUATOR

CROSS REFERENCE

This application claims the priority benefit of U.S. Provisional Patent Application No. 63/488,148 filed on Mar. 2, 2023, the entire contents of which are incorporated herein by reference.

FIELD OF THE INVENTION

The present invention generally relates to a rod pump system for use in a subterranean wellbore which may experience conditions conducive to gas locking.

BACKGROUND

While there has been expansive growth in the capital spending for drilling and completion operations of complex wellbores, there has been virtually no change in capital spend and operating budgets for the production and artificial lift operations of the same wellbores.

Complex wellbores present complex behaviors in the flow and mixing of the four phases found downhole: oil, water, gas, and solids. In the build section, known drilling techniques present a build rate limitation of approximately 30° per 100 m of measured depth as the orientation transitions toward the substantially horizontal wellbore segment. The vertical height of this build section in the wellbore may be at least a hundred meters in length and presents a tortuous path in which landing and operating pumping systems is challenging and often uneconomical. Therefore, most conventional pumping operators land pumping systems at or above the build section of the wellbore and thereby avoid the more tortuous section of the well's geometry. Consequently, many pumping systems are landed at least a hundred meters vertically above the producing formation and cannot rely on traditional pumping workflows deployed successfully in substantially vertical wellbores. In these workflows, the pump intake was located below the perforated interval and relied primarily on gravity separation, permitting the gas to escape from the fluids prior to the fluid entering the pump intake, therefore, creating highly reliable pump output and predictable pumping efficiencies.

In contrast, complex wellbores with long build and horizontal sections result in mixed multi-phase flow conditions being present at the pumping system intake. Therefore, the pump systems are challenged by the mixed phase flow at their intake, which can result in a gas lock condition of the pump. The mixed phases present at the pumping system intake require that the pumping system is equipped with provisions to maintain their efficiency in fluid pumping even in the presence of gas which may, at times, occupy the entire volume of the pump barrel.

A rod pumping application is known to have cyclical pressure conditions which are a function of the reciprocating nature of the normal rod pumping operation. There is an approximate three order magnitude difference in the specific gravities of the gas phase when compared to the liquid phase. During conditions of high gas content, it is possible that the maximum compressed gas pressure in the pump is not sufficiently large enough to overcome the tubing fluid head pressure above the traveling valve ball and seat seal, which will likely result in the pump becoming gas locked.

Existing solutions for gas lock mitigation in rod pumping systems are dependent upon inducement of artificial conditions such as friction, mechanical impact, and/or gas compression to instigate gas lock mitigation. These solutions suffer from well-known limitations and disadvantages.

There remains a need in the art for a reciprocating rod pump system which can efficiently operate in a complex wellbore and deal with mixed phase flow with high gas content.

SUMMARY OF THE INVENTION

Embodiments of the present invention relate to a pump system which is passively responsive to a condition when a compressible gas is dominant in the pump barrel and may automatically adjust the pump configuration to compensate.

Therefore, in one aspect, disclosed is a non-locking actuator system, for attachment to a traveling valve and disposed within a pump barrel defining a pump barrel volume, comprising:

(a) a ported seat plug configured to attach to a distal end of a traveling valve cage, and defining a port allowing fluid communication from the pump barrel volume to a central chamber which is open to the traveling valve when attached to the traveling valve;

(b) an intake section having a housing attached to a distal end of the ported seat plug and defining an interior volume, the intake housing defining at least one radial port for allowing fluid communication from the pump barrel volume into the non-locking actuator;

(c) a pressure cylinder attached to a distal end of the intake housing and defining an internal activation chamber;

(d) a distal inlet/outlet assembly connected to a distal end of the pressure cylinder and having a specific gravity valve closing a distal end of the activation chamber, the specific gravity valve comprising a specific gravity element having a specific gravity between that of a gas and a liquid, such that the specific gravity element sinks in a gas and floats on a liquid, thus moveable between an open position when a liquid is present in the assembly and a closed position when a gas is present in the assembly;

(e) a reciprocating actuator assembly comprising a prong having a proximal end disposed in the ported seat plug central chamber and a distal end connected to a rod crossover which extends distally into the intake housing;

(f) an intake manifold disposed within the intake housing, defining a fluid flowpath from the at least one radial port into a check valve chamber formed within a distal end of the rod crossover;

(g) a check valve permitting fluid flow from the check valve chamber to the activation chamber when the check valve is open, but which does not permit fluid flow from the activation chamber to the check valve chamber; and (h) a bias piston attached to a distal end of the rod crossover and sealed to an inner surface of the pressure cylinder, wherein the bias piston is responsive to a pressure differential between the pump barrel volume and the activation chamber, to move between a non-actuated distal position and an actuated proximal position, wherein the bias piston is biased into the non-actuated position, and wherein the bias piston moves the prong proximally to impinge on a traveling valve ball to unseat the traveling valve ball when in the actuated position.

In one embodiment, the specific gravity element is a hollow gas-filled sphere.

In one embodiment, the intake manifold defines a fluid flowpath from the at least one radial port into a bias piston chamber defined between the intake housing, rod crossover, and a proximal surface of the bias piston.

In one embodiment, the rod crossover is sealed to an interior surface of the ported seat plug with a solid wiper ring seal or a seal gland comprising a stationary seal and a split wiper ring.

In some embodiments, the intake manifold comprises a filter element to remove solid particles from fluid entering the non-locking actuator. Preferably, filter discs are inserted into the at least one radial port and retained by a hollow set screw. In an alternative embodiment, a cylindrical porous filter element, such as a sintered porous tube, may be disposed around or within the intake manifold.

In some embodiments, the specific gravity inlet/outlet assembly comprises a filter to remove solids from fluid entering the activation chamber.

In some embodiments, the ported seat plug comprises stationary rod seals and at least one split rod scraping element to wipe the seal surface of the rod and exclude solids from entering the intake manifold, and a seal washer and seal gland element each with a seal face and when combined and axially loaded with assembly torque form the closed seal gland which houses the at least one proximal stationary rod seal.

In another embodiment, the ported seat plug contains at least one solid wiper/scraper element to wipe and seal the surface of the rod.

In another aspect, disclosed is a non-locking actuator configured to connect to a distal end of a traveling assembly, and disposed within a pump barrel defining a pump barrel volume, the actuator comprising a ported seat plug, an intake section connected to a distal end of the ported seat plug and comprising an intake manifold open to the pump barrel volume, an actuator section having a pressure cylinder and connected to a distal end of the intake section and comprising a bias piston sealed within the pressure cylinder, an activation chamber formed within the pressure cylinder by a distal inlet/outlet valve and a distal surface of the bias piston, with a check valve disposed at a proximal end of the bias piston, and a reciprocating actuation assembly connected to the bias piston and comprising a prong disposed within the ported seat plug for impinging on a traveling valve ball when in an actuated position, the non-locking actuator defining:

a. A first internal bi-directional flowpath from the pump barrel volume into the traveling valve assembly through the ported seat plug, wherein the first flowpath is always open;
b. A second equalization flowpath from the pump barrel volume through the intake manifold and into a check valve chamber formed proximally of the check valve, and unidirectionally into the activation chamber through the check valve;
c. A third internal bi-directional flowpath from the pump barrel volume into the activation chamber through the distal inlet/outlet valve;
d. wherein the distal inlet/outlet valve comprises a specific gravity element responsive to the density of fluid in the inlet/outlet valve;
e. wherein the second and/or third flowpaths are open to the activation chamber when pressure in the pump barrel volume is greater than the activation chamber pressure;
f. wherein the third flowpath is open to the activation chamber when the specific gravity of the fluid in the inlet/outlet valve is greater than that of the specific gravity element and is closed when the specific gravity of the fluid in the inlet/outlet valve is less than that of the specific gravity element.

In another aspect, disclosed is a method of operating a reciprocating rod pump positioned non-horizontally, the rod pump having a traveling valve and a pump barrel, comprising the steps of:

a. Providing a non-locking actuator having a reciprocating actuation assembly for impinging on a traveling valve ball to open the traveling valve when a gas dominates in the pump barrel, and installing the non-locking actuator on a traveling assembly of the reciprocating rod pump;
b. When a gas dominates in the pump barrel, creating a sealed activation chamber within the non-locking actuator, having a pressure equal to the pump barrel pressure at the end of a downstroke;
c. Activating the reciprocating actuation assembly to open the traveling valve, by a pressure differential between the activation chamber pressure and the pump barrel pressure during the next upstroke; and
d. Priming the pump barrel with liquids passing downward through the open traveling valve.

Preferably, the activation of the reciprocating actuation assembly is passive and automatic in response to the fluid conditions in the pump barrel. In one embodiment, the sealed activation chamber is created with a specific gravity element having a specific gravity intermediate that of a liquid and of a gas, moveable within a specific gravity valve to close when the specific gravity valve is filled with a gas.

In one embodiment, pressure in the activation chamber and in the pump barrel equalizes through either or both a proximal or distal end of the activation chamber, during or after the pump barrel has been primed with liquid. The non-locking actuator comprises a check valve at the proximal end of the activation chamber and a specific gravity valve at the distal end of the activation chamber.

In some embodiments, the activation chamber has a designed volume to ensure a sufficient mass of gas which when trapped in the activation chamber permits sufficient pressure differential across the bias piston to actuate the tool to relieve a gas locked pump condition.

BRIEF DESCRIPTION OF THE FIGURES

The accompanying drawings, which are incorporated herein and form a part of the specification, illustrate some, but not the only or exclusive, examples of embodiments and/or features.

FIG. 1 shows the structural assemblies of a conventionally known rod pump, wherein FIG. 1A and Detail AA is the tubing string end assembly configured to receive a rod pump assembly.

FIG. 5B and Detail View HH/JJ portray the pump with the non-locking actuator in the top stroke position in a fluidic environment.

FIGS. 6A and 6B are longitudinal transverse cross sections through the non-locking actuator pump assembly in the operational positions appropriate to the pump position in a gaseous environment where the pumped media is predominantly a gas, wherein FIG. 6A and Detail View KK portray the pump with the non-locking actuator in the bottom stroke position in a gaseous environment. FIG. 6B and Detail View LL/NN/MM portray the pump with the non-locking actuator in the top stroke position in a gaseous environment.

FIGS. 7A and 7B are longitudinal transverse cross sections through the non-locking actuator assembly and a typical conventional pump traveling valve cage, traveling valve ball, and traveling valve seat showing the various internal components and associated compartments/regions which comprise the disclosed systems, wherein FIG. 7A depicts the non-locking actuator assembly in the pumping state. FIG. 7B depicts the non-locking actuator in an actuated position.

FIG. 8 shows a longitudinal transverse cross section of the non-locking actuator assembly with a conventional rod pump traveling valve and closed cage attached to the proximal end, which is comprised of four main sub-assemblies each depicted schematically in this drawing. The four main sub-assemblies are the closed cage traveling valve (a subset of a conventional rod pump but shown here for completeness), the inlet/outlet manifold, actuator, and the specific gravity inlet/outlet. Section A-A depicts the holes passing through the keyhole washer.

FIG. 9A is a longitudinal cross section (section M-M) straight through the non-locking actuator assembly in the pumping state which reveals the axially offset threaded holes in the inlet/outlet manifold and threaded filter elements which communicate with the activation chamber D. FIG. 9B shows a longitudinal cross-section along line P-P in which the top-half of the section line is oriented at 45° to the vertical section and the bottom half of the section line is aligned vertically. This view is selected to represent the radially disposed threaded holes or ports, hollow lock set screws and filter discs in the inlet/outlet manifold and their position relative to the other components in the assembly. FIGS. 9C and 9D show alternative embodiments of the port configuration and intake manifold allowing fluid to enter the non-locking actuator.

FIGS. 10A, 10B and 10C are cross sections (section A-A) straight through the intake manifold and an aligned cross section (section B-B), wherein the section line at 45° to vertical is rotated to align with the vertical section line through the bottom half of the part to reveal the radially disposed threaded hole pattern. FIG. 10A is the inlet/outlet manifold oriented to display the proximal end view out of the page. FIG. 10B is the view which shows the longitudinal cross section A-A straight through the part. FIG. 10C shows the result of the aligned cross section B-B wherein the hole pattern existing at 45° to the section geometry straight through the part is rotated coincident with vertical and is shown on the top half of this section view. The bottom half of the view depicts the geometry resulting from a longitudinal vertical section straight through the part.

FIG. 11A is a longitudinal and a transverse vertical cross section of an alternate embodiment of the non-locking actuator assembly. FIG. 11B is a dimensional view of the original embodiment prong from the non-locking actuator assembly. FIG. 11C is a dimensional view of the alternate embodiment prong from the non-locking actuator assembly. FIG. 11D is a detail view of the alternate embodiment prong in the context of the non-locking actuator assembly. FIG. 11E shows an alternative embodiment of a distal inlet/outlet filter element.

FIG. 18 is a graph of the pressures versus time during a pump cycle of a rod pump which includes a no-lock valve, and where the acronyms are defined as follows: PDP—Pump Discharge Pressure, Pbbl—Pressure internal to pump barrel, ICP—Internal cavity pressure of the activation chamber, PIP—Pump intake pressure. FIG. 18A is a graph showing PDP, ICP, Pbbl and PIP of pump operation in a gaseous environment. FIG. 18B depicts the pressures during pump operation in a fluidic environment.

DETAILED DESCRIPTION

Figures 1A, 1B, 1C, 1D:
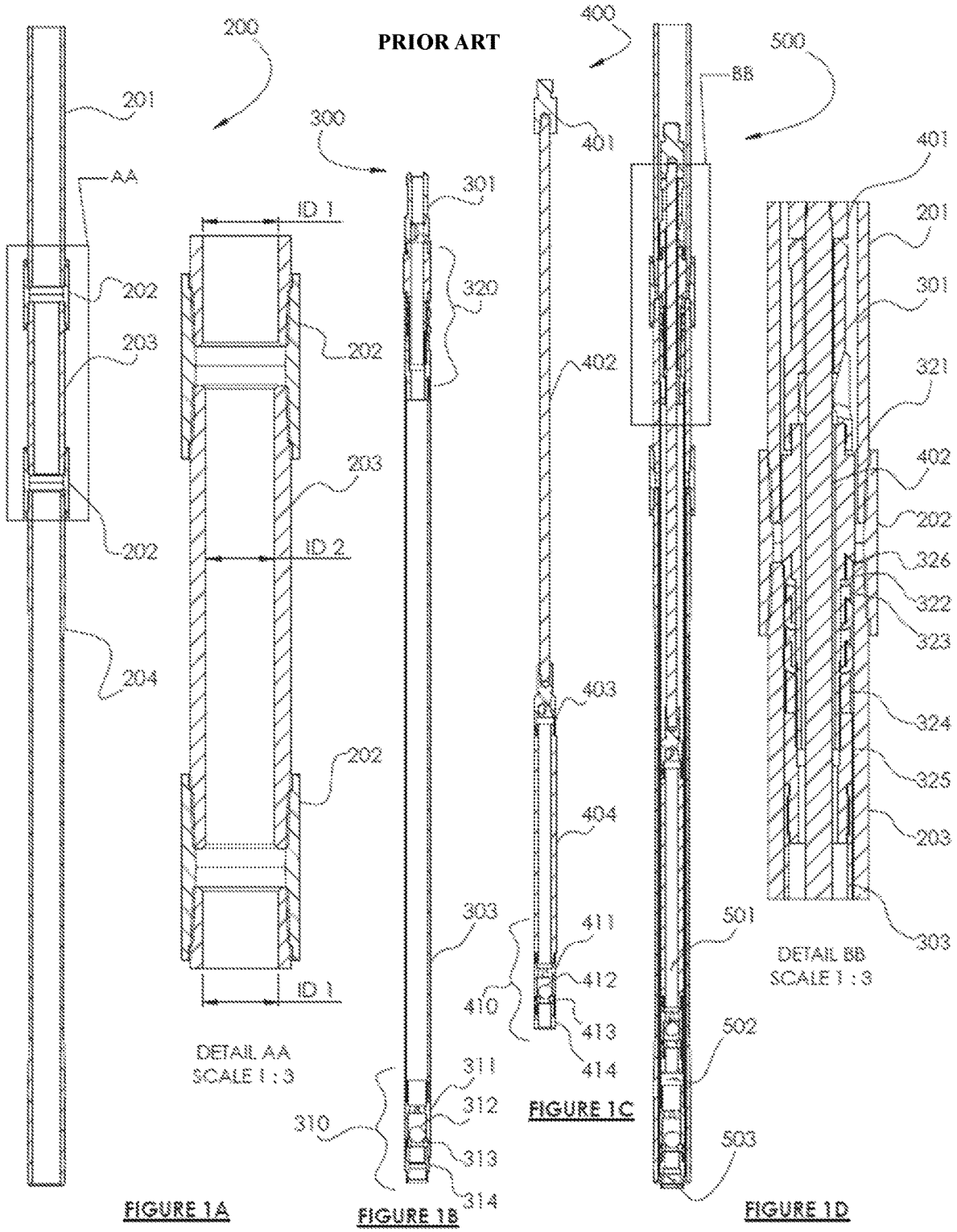
FIG. 1B/1C display the standing and traveling assemblies respectively which comprise a conventionally known rod pump assembly.
FIG. 1D and Detail BB is a combination of the previously disclosed sub-assemblies comprising a working conventional rod pump assembly.

The systems and methods disclosed herein are intended to improve pumping efficiencies in a reciprocating rod pump in environments where high gas content is likely. In one aspect, a non-locking actuator disclosed herein may be adapted to any conventional rod pumping system, as it may be appended to a traveling valve closed cage within a conventional rod pump in place of a conventional seat plug. As described below, the non-locking actuator reacts to the pumping conditions which result from a gas locked pump condition and is therefore a passive system.

In one aspect, the present disclosure provides a system and method for automatically overriding a gas locked pump state without requiring operator intervention. A traveling valve assembly having a non-locking actuator automatically prevents gas locking of the pump and the consequent overheating that may otherwise occur. The gas is permitted to dissipate, returning the pump to return to a fluidic state and permit normal pumping of liquids up the production tubing.

The systems described herein comprise a rod pump system which is configurable for many different pump configurations, wellbore configurations and fluid compositions.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure. As used herein, the term "proximal" refers to the end of the system or component that is proximate to the surface, and the term "distal" refers to the end of the system or component that is distal from the surface, in describing the systems or components herein that involve downhole pumping operations underneath the surface of the earth.

As used herein, the term "fluid" or "fluidic" refers to a fluid that is predominantly liquid or has a specific gravity substantially higher than a gas. It is used herein to refer to the high-quality liquid fluid state that permits normal rod pump operation.

Reciprocating ROD Pump

One skilled in the art will readily understand the design and configuration of a standard reciprocating rod pump, however, a short description is useful to understand the operation of a non-locking actuator described below.

FIG. 1 illustrates one example of a prior art, conventional reciprocating rod pump. Production tubing 201 extends to the surface and typically is made up of lengths of tubulars joined by tubing collars 202. A pump seating nipple (PSN) 203 is part of the tubing string and has a nominally smaller, polished inside diameter in comparison to the adjacent tubing components. The PSN 203 receives a cup seating assembly 320 which is the proximal end of a conventional rod pump standing assembly. A tubing collar 202 and tubing pup joint 204 make up the tail joint and surround the rod pump assembly along its length at the terminus of the tubing string.

A complete reciprocating rod pump assembly of the type depicted in FIG. 1 includes a traveling assembly 400 installed within and surrounded by a standing assembly 300. The reciprocating motion of the traveling assembly 400 within the standing assembly 300 is bounded on the upstroke (at the upper limit) when the top face of the top plunger cage 403 meets with the bottom face of the seating cup assembly 320; and the downstroke is bounded by the coincidence of the valve rod bushing 401 bottom face and the valve rod guide 301 top face.

A standing assembly 300 is generally comprised of a valve rod guide 301, a seating cup assembly 320, pump barrel 303 and a standing valve assembly 310. The standing valve assembly comprises a closed end barrel cage 311 which surrounds and houses the ball 312 and the seat 313 the movement of which is bounded on top by an internally disposed face which is perforated to receive flow around the ball in the open position and on bottom by the barrel cage bushing 314.

The traveling assembly 400 is generally comprised of a valve rod bushing 401 which connects the valve rod 402 to the reciprocating rod string. The valve rod 402 is of a length which is selected based on the required pump stroke length and is customized for the given application. The valve rod 402 connects between the valve rod bushing 401 and the top plunger cage 403 at its distal end. The plunger 404 attaches to the distal end of the top plunger cage 403. The traveling valve cage 411 contains a traveling valve ball 412 which seats on the traveling valve seat 413. The distal end of the traveling assembly 400 ends conventionally with a seat plug 414.

FIG. 1D and detail BB depict a longitudinal cross section through a reciprocating rod pump 300/400 landed within and surrounded by the tubing end sub-assembly 200. Seating cups 322 are alternately stacked with seating cup rings 323 and surround the cup seating mandrel 321. The seating cup stack is energized by the seating cup nut 324 and the setting energy locked into the assembly using the seating cup bushing 325 both of which are threadingly engaged with the cup seating mandrel 321. The cup seating mandrel 321 has a no-go shoulder 326 which is sufficiently small to easily pass through the inside of the tubing string but sufficiently large to not pass through the PSN 203. The seating cups 322 which surround the cup seating mandrel 321 form an interference seal around the inner surface of the PSN 203. Fluid head above the pump within the production tubing enhances this seal and maintains the pump in place. Thus, pressure within the production tubing is isolated from well annulus (external to the production tubing) and the producing formation.

Figures 2, 2A, 2B, 3, 3A, 3B:
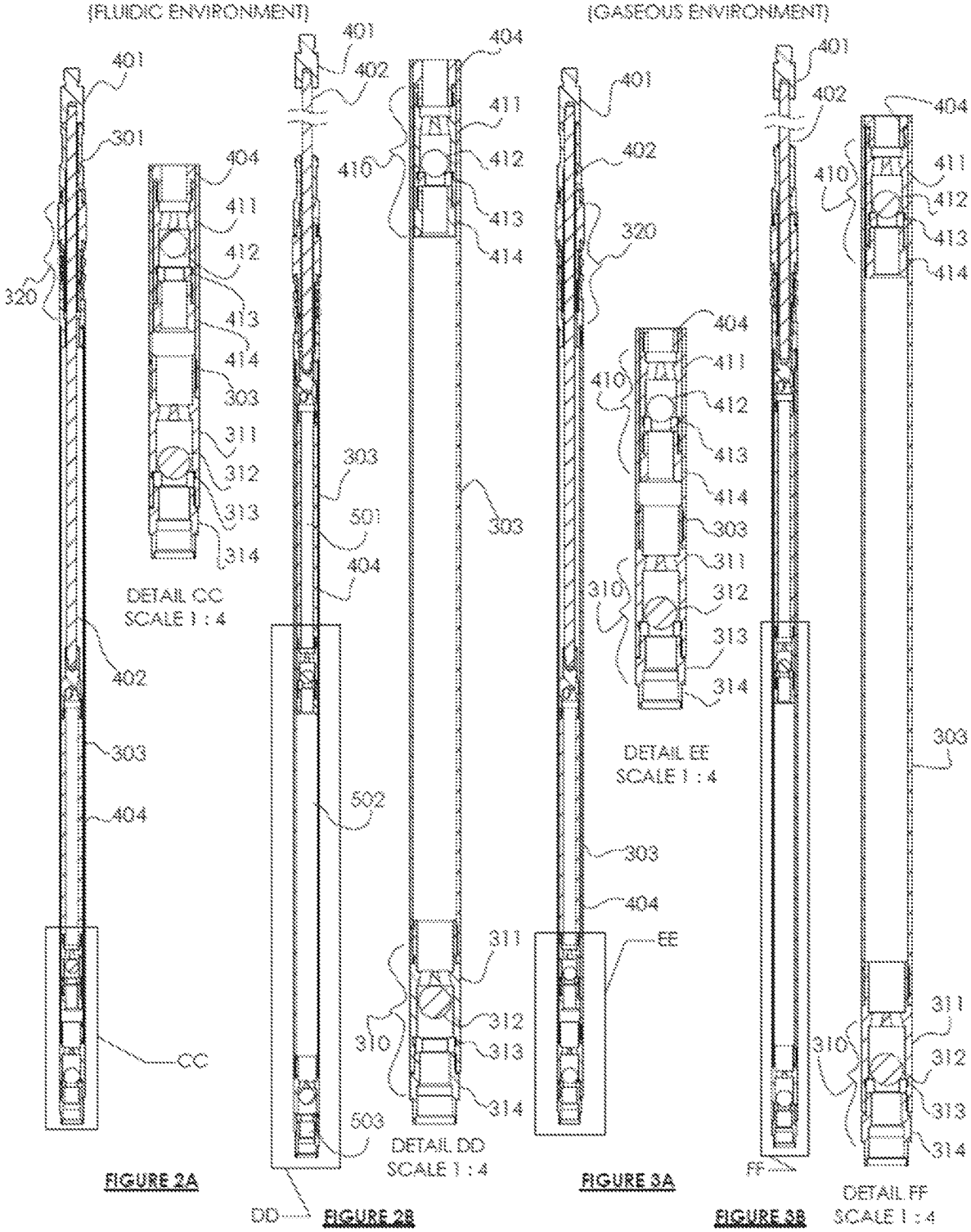
PRIOR ART FIGURE 2
FIGURE 2B PRIOR ART
FIG. 2 details a conventional rod pump and its operation in a fluidic environment, wherein FIG. 2A and Detail CC is the pump shown at the bottom of its stroke where the detail views focus on the valves of the pump and their positions appropriate to pump operation in fluidic environments.
FIG. 2B and Detail DD is the same pump depicted at the top of its stroke.
FIG. 3 is the same conventional pump with operation in a gaseous environment, wherein FIG. 3A and Detail EE is the same pump shown at the bottom of its stroke where the detail views focus on the valves within the pump and their positions typical of operations in gaseous environments.
FIG. 3B and Detail FF is the same pump shown at the top of its stroke.
Figure 4:
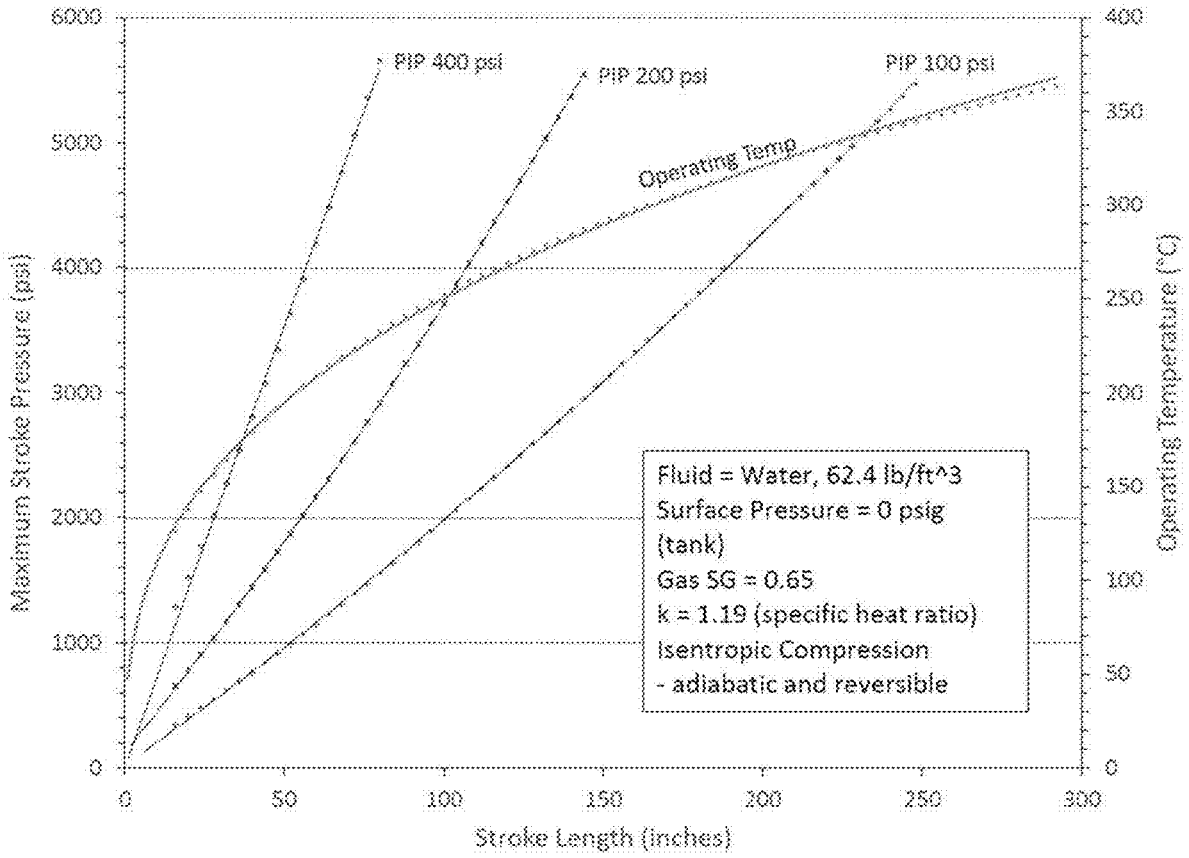
FIG. 4 shows a graph of the available rod pump compression at various intake pressures and plotted against pump discharge pressure; this graph also presents an operating temperature curve resulting from compression of the gas within a pump stroke.

FIGS. 2 and 3 represent a conventional API pump operation in fluidic and gaseous environments, respectively. As is well known, the traveling valve 410 reciprocates within the pump barrel and intermittently seals the region 501 above the traveling valve, inside the plunger 404, through the top plunger cage 403, through the space surrounding the valve rod 402 and enclosed by the pump barrel 303, continuing through the space surrounding the valve rod 402 and surrounded by the cup seat assembly 320 inner surface and continuing into the tubing 201. The region 501 is intermittently isolated from the region 502, the space in between the traveling valve 410 and the standing valve 310, which defined space expands and contracts with the action of the pump stroke.

The standing valve 310, affixed to the pump barrel 303 in the standing assembly 300, intermittently seals the region 502, as previously described, from the region 503 which is constantly open to the wellbore annulus and the producing formation.

The pressure in region 501 dictates the pump discharge pressure (PDP), while pressure in region 502 is pressure internal to pump barrel (Pbbl), and pressure in region 503 defines pump intake pressure (PIP). PDP is always isolated from PIP, while normal pump operation sees Pbbl equalize with and alternate between PDP and PIP during downstroke and upstroke respectively.

In a fluidic environment, shown in FIG. 2, the traveling valve opens on the downstroke as the fluid in region 502 is substantially incompressible, and Pbbl equalizes with PDP. On the upstroke, the Pbbl falls below the PDP and equalizes with the PIP. In FIG. 3, when gas predominates in the pump barrel, the traveling valve remains closed during the downstroke as Pbbl remains below PDP. As long as the Pbbl remains below the PDP, the traveling valve will remain closed, resulting in the gas locking problem described above.

Non-Locking Actuator—General Principles

A system disclosed herein comprises an activation chamber D which is normally open to the fluids present in the pump barrel but closes when gas dominates in the pump barrel. When closed, the activation chamber D will have a pressure greater than in the pump barrel during an upstroke of the traveling valve, which causes an actuator assembly to open the traveling valve and displace the gas in pump barrel with a liquid. Embodiments of the present invention may be used in combination with any reciprocating rod pump with a traveling valve assembly which reciprocates within a pump barrel.

Therefore, in one aspect, disclosed is a non-locking actuator 1 which actuates a prong to open the traveling valve when a compressible gas in the pump barrel causes Pbbl to remain below PDP on the downstroke. The non-locking actuator is responsive to a pressure differential present at any time between the activation chamber D and the pump barrel 303. This pressure differential is only realized when gas locking conditions are present within the pump barrel. During normal operation, the activation chamber D has a pressure ICP which equalizes with Pbbl, allowing production fluids in the pump barrel to bypass the non-locking actuator assembly. As shown in FIG. 7A, the non-locking actuator is in a distal, non-actuated position during normal pumping of high-quality fluids, and as shown in FIG. 18B, when pumping high-quality fluids, Pbbl and ICP rapidly rise and fall to equalize with PIP during the upstroke and equalize with the PDP during the downstroke. However, when gas dominates the pump barrel, Pbbl remains below PDP, the activation chamber D becomes sealed, and ICP (Activation Chamber Pressure) will then become greater than Pbbl when Pbbl drops during the upstroke, as seen in FIG. 18A. This results in actuation of a prong which unseats the traveling valve ball, causing liquid in the production tubing above the traveling valve to refill the pump barrel.

The activation chamber D becomes sealed because of the action of a specific gravity element 71 which is responsive to fluid density differences between fluids (oil and water) and gases in the pump barrel 303. When gas is the dominant medium in the pump barrel 303, the specific gravity element 71 closes and isolates pressure within the non-locking actuator (ICP) from Pbbl, and initiates activation of the non-locking actuator 1 to open the traveling valve during the next upstroke. This activation occurs because Pbbl falls below the ICP during the upstroke.

In one embodiment, the system disclosed herein comprises a non-locking actuator 1 having a ported seat plug 30, an actuator section 60 including an intake section, and a specific gravity section (100). The non-locking actuator 1 is disposed within the pump barrel, connected to the distal end of the traveling valve 410, in place of the conventional seat plug 414, one example of which is shown in FIG. 1C.

Figures 5A, 5B:
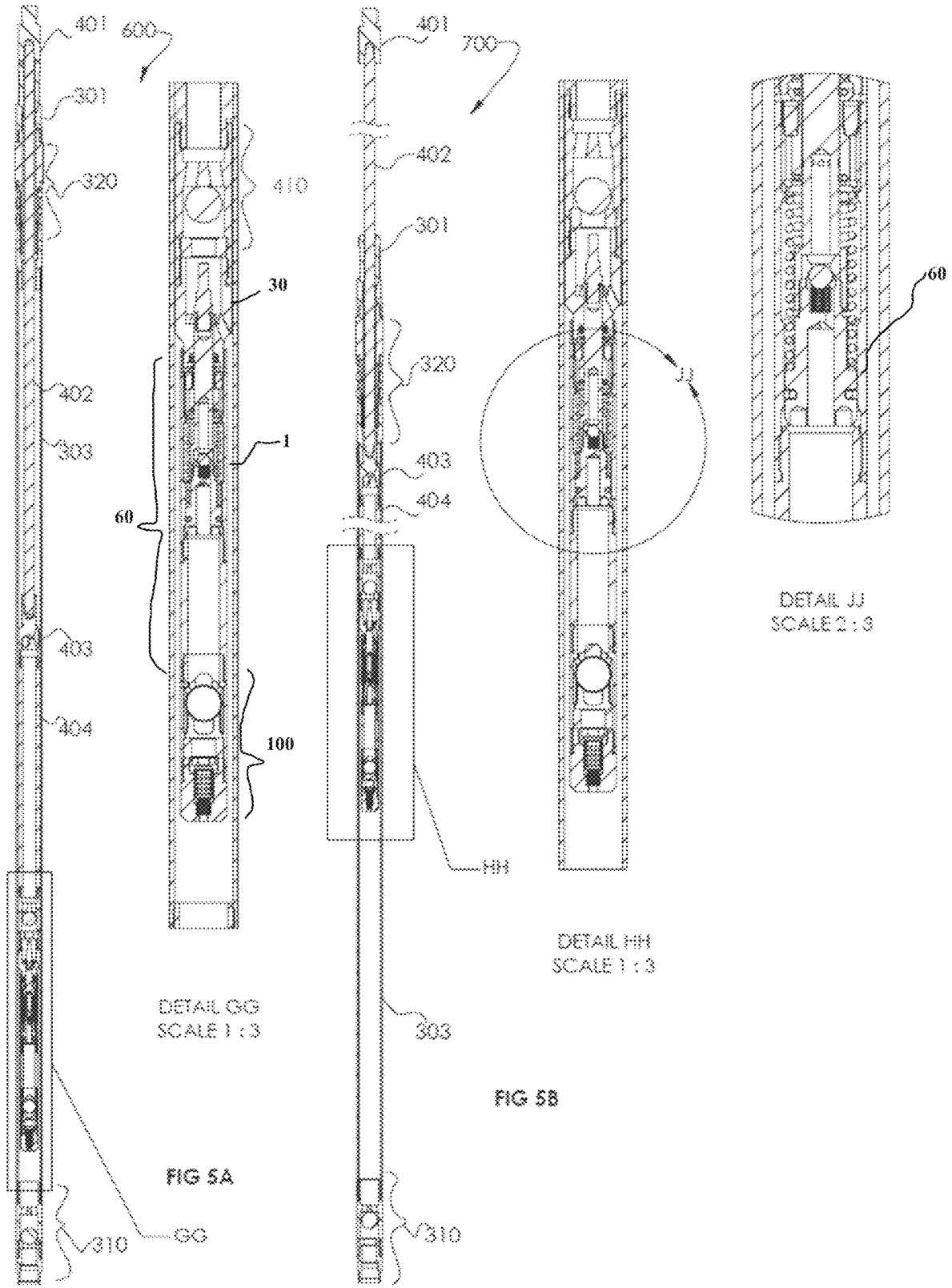
FIGS. 5A and 5B are longitudinal transverse cross sections through a non-locking actuator pump assembly in the operational positions appropriate to the pump position and the fluidic environment where the pumped media is predominantly a liquid, wherein FIG. 5A and Detail View GG portray the pump with the non-locking actuator in the bottom stroke position in a fluidic environment.

With reference to FIGS. 5A and 5B, a non-locking actuator assembly is connected to an otherwise conventional reciprocating rod pump. In one example, the non-locking actuator may be configured to replace a conventional traveling assembly seat plug (414 in FIG. 1C). The pump barrel must be of sufficient length to accommodate the length of the non-locking actuator, and therefore will be longer than a conventional pump barrel.

FIG. 5A and detail GG shows the configuration of a non-locking actuator 1 at the bottom of the pump downstroke. In these views, the traveling and standing valves, 410, 310 respectively, are shown in their proper positions representing operations in a fluidic pumping environment and which figures also display the operating positions of the non-locking actuator internals in the fluidic pumping state.

FIG. 5B shows the same pump shown in the top of the upstroke, in which the valves are in their proper fluidic operating states and the internals of the non-locking actuator 1 are also in their appropriate fluidic operating states.

FIGS. 6A and 6B shows a pump of the same configuration but with the components in a position which represents operations in a gaseous environment. FIG. 6A is the same pump shown at the bottom of the stroke position whereas FIG. 6B is shown at the top of the stroke position, with equalization across the traveling valve initiated by the non-locking actuator assembly 1.

Ported Seat Plug

The ported seat plug 30 is ported for bi-directional flow: flow between the pump barrel 303 to the inside of the production tubing 201 above the pump transits the flow ports in either direction. This flow path is isolated from the internals of the non-locking actuator by a sealing assembly within the distal end of the ported seat plug. A fluid-tight seal is not required, but it is preferred to ensure solids do not enter the non-locking actuator 1. The sealing assembly may comprise a split wiper 34 and stationary seal 35 which seal on the reciprocating rod 33. Alternatively, a solid wiper seal may be implemented. The split wiper 34 scrapes the surface of the rod 33, excluding debris from entering the region of the assembly where the static rod seal 35 resides. The proximal rod seal 35 is housed on the upper and lower ends by the seal washer 36 and the seal gland 37 respectively, which when stacked together form a closed seal gland containing the static rod seal 35 and when loaded axially by the actuator connection torque provide a leak tight connection.

The rod seals 35, 43 may be constructed from a polymer, steel, nickel alloy, thermoplastic, brass, graphite, fiberglass, aluminum material or any combination thereof.

Actuator Assembly and Intake Section

As described above, when the plunger 404 is in the top position and the pump is filled with high quality, incompressible fluid, as the plunger 404 descends the pressure equalizes across the traveling valve ball 412 by acting on the bottom of the traveling valve via the ports through the ported seat plug 30. On the other hand, when the pump barrel 303 volume is occupied by gas, fluid from above the pump in the production tubing will not pass downward through the ported seat plug 30 into the pump barrel 303. This occurs when there is insufficient energy due to compression on the downstroke to overcome the pressure which resides in the tubing 201 above the traveling valve and rod pump.

In this condition, the non-locking actuator 1 will unseat the traveling valve ball 412 on the next pump upstroke by physical activation of the prong, which causes pressure equalization between the tubing above the pump and the pump barrel below.

In one embodiment, the actuator assembly comprises: a) a prong 31 for reliable unseating of the traveling valve ball in gas locked conditions; b) a rod crossover 33 having a length sufficient to span the intake section components, rigidly joining the prong 31 and a bias piston 60 for reliable reciprocating movement in loaded and unloaded conditions and in response to fluidic conditions within the pump barrel; c) a sliding and sealing interface between the intake manifold and the rod crossover for isolation between the pump barrel and the actuator internal components; d) a compression coil spring configured to retain the bias piston in its distal non-actuated position when no differential pressure exists across it; e) a check valve which permits flow from the pump barrel internal region into the activation chamber and prevents flow from the internal cavity towards the pump barrel; f) the bias piston which is rigidly connected to the distal end of the rod crossover and is slidingly and sealingly engaged with the internal polished surface of the pressure cylinder and is responsive to pressure differences between the internal volume of the pump barrel and the activation chamber.

The check valve assembly facilitates efficient filling and draining of activation chamber by exchanging fluids with the surrounding pump barrel and is biased into a normally closed position by a compression coil spring configured to retain the check ball against the check seat when no differential pressure exists. Thus, the check valve assembly provides an equalization flowpath at the proximal end of the activation chamber.

In one embodiment, with reference to FIG. 8, the actuator assembly is disposed distally to the ported seat plug 30 and is disposed within an intake housing 20, which houses the prong 31, the rod crossover 33, the intake manifold 38, cavity filters 40, actuating chamber filters 39, static rod seals 35, 43, keyhole washer 41, and the check valve assembly. The bias piston 60 and accompanying piston seal 61 are disposed within a pressure cylinder 62. All fluid flowpaths which lead to the activation chamber or are in contact with the actuation components should be filtered to prevent solids buildup which could interfere with operation.

The rod crossover is furnished with at least one port radially disposed through its wall to permit pressure communication/equalization between the intake manifold 38 and a check valve chamber C.

The intake housing 20 is attached to a distal end of the ported seat plug 30. The intake manifold 38, filters 39, 40, distal rod seal 43 and keyhole washer 41 are all concentrically disposed within the proximal end of the intake housing 20 and the distal end face of the keyhole washer 41 impinges on the internal square abutment on the inner surface of the intake housing 20 located a distance approximately equal to one-third of the overall length from the proximal end face of the same.

The intake manifold is flanked on the proximal end by the seal gland washer 37 for the proximally located static rod seal 35. The distal end face of the intake manifold 38 is flanked by the keyhole washer 41. The distal end face of the intake manifold 38 contains a profile which forms the seal gland for the distal static rod seal 43. When combined with the keyhole washer 41 and loaded axially by the connection torque, these two components form the closed seal gland for the distal rod seal 43.

In one embodiment, a series of ports 90, 91 and 92 provide fluid communication from outside the intake housing 20 in and through the intake manifold 38. As shown in FIGS. 10A to 10C, the intake manifold defines at least one axially oriented and offset threaded port 90 which provides fluid communication with the small, adjacent, axially offset port 91 through the intake manifold which, next through a port 44 in the keyhole washer 41, and in turn, communicates to the bias piston chamber G which is formed proximally by the distal end face of the keyhole washer 41, and distally by the bias piston 60 and piston seal 61.

At least one radially disposed port 92 leads to ports 91 and 92, thereby providing a flow path between bias piston chamber G and the pump barrel volume. The number, size and orientation of the flow ports 92 may be varied to modulate the system performance.

Preferably, port 92 includes a filter element to ensure solids do not enter the actuator sub-assembly. For example, each of these ports 92 may receive a filtration disc 40 which may be inserted into the port 92 and retained with a hollow set screw. The filtration discs 40 which are comprised of the same or different media, and/or comprised of the same or different pore sizes. Pore sizes for the filtration media may be selected based upon sizes of the solids expected within the production environment and/or the surface tension of the fluids anticipated based on the operating conditions in the wellbore environment.

A filter may be constructed of, for example, sintered metal, porous metal fabric, wire wool, or any other suitable materials known to a person skilled in the art. Such filters may be in the form of a basket, disc, cone, cylinder, hemisphere, or any other suitable forms as known to a person skilled in the art.

The distal end face of the keyhole washer 41 forms the proximal end of the bias piston chamber G, whereas the distal end of the bias piston chamber is formed by the bias piston 60 and piston seal 61. The bias piston 60 slides within the intake housing 20 and is connected to the rod crossover 33 and is thus directly connected to prong 31.

FIG. 8 shows radially disposed ports (20*a*) in the wall of the intake housing 20 into the open space between the outer surface of the intake manifold 38 and the inner surface of the intake housing 20, and in turn, through the radially disposed ports 92, hollow lock set screws 45, and filter discs 40, and next through the ports M which are radially disposed through the wall of the rod crossover 33. Finally, the pressure enters the check valve chamber C internal to the rod crossover 33 and bounded distally by the check valve assembly 50, 51, 52.

FIG. 9A is a longitudinal cross section (section M-M) straight through the non-locking actuator assembly in the pumping state which reveals the axially offset threaded holes in the inlet/outlet manifold and threaded filter elements which communicate with bias piston chamber G. Radial ports 20*a* lead to the axially offset holes 90, 91 in the intake manifold. FIG. 9B shows a longitudinal cross-section along line P-P in which the top-half of the section line is oriented at 45° to the vertical section and the bottom half of the section line is aligned vertically. This view shows the radially disposed threaded holes or ports 92, hollow lock set screws 45 and filter discs 40 in the intake section, and their position relative to the other components in the assembly.

FIGS. 9C and 9D show alternative embodiments of the port configuration and intake manifold allowing fluid to enter the non-locking actuator and alternative embodiment of the actuator prong which includes a cone shaped upset 103 which terminates with an external square abutment 104, which surrounds a pin end 105 of the rod crossover 33.

In FIG. 9C, multiple ports 20*c* in the intake housing are provided. In this embodiment, the seals above and below the intake manifold are omitted as well as the keyhole washer and the proximal rod seal split gland hardware, replaced with a single solid wiper ring 100 positioned at the distal end of the ported seat plug 30, for sealing against the rod crossover. A centralizing split ring 101 is also provided around the bias piston. The annular void L between the rod crossover 33 and the inner surface of the intake manifold 38 leads directly to either the bias piston chamber G or the check valve chamber C through openings M in the rod crossover 33.

In FIG. 9D, a cylindrical filter element 102 and resilient washer 106 are positioned in an annular void surrounding the intake manifold 38 and replace the disc filter elements 40 and ports 92 in other embodiments. The cylindrical filter 102 may be comprised of the same porous, sintered material described above. A perforated washer 107 replaces the keyhole washer 41 and provides additional flow area through the intake assembly and into either the bias piston chamber or the check valve chamber.

Fluid flow between the check valve chamber C and the activation chamber D is governed by a check valve 50, 51, 52 which permits flow into the activation chamber D of the non-locking actuator assembly but prevents flow in the reverse direction. This check valve assembly facilitates efficient filling and draining of the activation chamber D by exchanging fluids with the surrounding pump barrel.

The prong 31 is rigidly connected, such as by a threaded connection, to the proximal end of the rod crossover. In one embodiment, the prong has an upset outside diameter substantially similar to the rod crossover, as shown in FIG. 8 and FIG. 11B. In an alternative embodiment, as shown in FIG. 11A, the prong is furnished with a shoulder 80 having an upset outside diameter which is greater than the distally attached rod crossover 33. This shoulder impinges on an internal square abutment on an inner surface of the ported seat plug and contacts the internal abutment in the ported seat plug when the actuator assembly is in its home position. The shoulder 80 closes the region of the tool above the stationary rod seal and split wiper element and excludes solids from entering this region. In an alternative embodiment shown in FIGS. 9C and 9D, the prong may be furnished with a cone shaped external upset which terminates in a distal square external abutment.

FIG. 11C is a dimensional view of the alternate embodiment prong from the non-locking actuator assembly. FIG. 11D is a detail view of the alternate embodiment prong in the context of the non-locking actuator assembly.

The pressure cylinder 62 and specific gravity closed cage 70 are threadingly connected to the intake housing 20, and whose overall length is configured such that the activation chamber D has sufficient volume to permit activation of the prong assembly.

The activation chamber D has a proximal region E and a distal region J, and is formed within the pressure cylinder 62, between the bias piston at its proximal end and the distal inlet/outlet assembly at its distal end, the specific gravity element 71 at its distal end. The activation chamber D comprises the combined volume of a) an internal volume of the bias piston distal to the line contact interface between the check ball and seat (E); b) the internal volume of the pressure cylinder; and c) the internal volume of the specific gravity cage proximal to the line contact interface between the specific gravity element and the specific gravity seat (J) and less the total volume occupied by the specific gravity element.

Activation of the non-locking actuator (and thus the prong assembly) is based upon isolating a sufficient mass of gas within the activation chamber D (including regions E and J) such that the minimum force generated following maximum bias piston travel is greater than the force generated on the valve ball, by the tubing pressure, to keep it closed. Thus, the total volume within the activation chamber D may be configured such that the minimum chamber pressure following maximum bias piston travel translates to a force between the prong end face and the traveling valve ball, which is greater than the force exerted proximally on the valve ball by the tubing fluid head pressure plus the surface wellhead pressure.

The force acting on the traveling valve ball 412 in direction X (FIG. 8) is generated by the head pressure from the fluid in the tubing string 201, and the pressure at the wellhead on surface, multiplied by the cross-sectional area bound by the traveling valve ball 412/seat 413 seal contact line. Thus, the force generated by the pressure within the activation chamber D must exceed this force tending to close the valve ball.

Distal Inlet Outlet Assembly and the Specific Gravity Element

In some embodiments, the distal inlet/outlet assembly includes a specific gravity closed cage assembly which comprises proximally and distally threaded ends and an internally, concentrically disposed slotted insert which permits flow around the specific gravity element for efficient filling and emptying of activation chamber D. The specific gravity seat has a line contact interface with the spherical specific gravity element to seal the activation chamber D.

The insert-style, specific gravity cage 70 houses the specific gravity element 71, and comprises a distal, curved surface K limiting upward travel of the specific gravity element 71. The specific gravity seat 72 is located adjacent and distal to the slotted insert cage 70*a*, and concentrically disposed within the specific gravity closed cage 70. The slotted insert cage 70*a* may be integrally formed with the specific gravity closed cage 70, or the slotted insert may be a separate component that is inserted into the specific gravity closed cage.

In an alternative embodiment, the specific gravity closed cage and its associated internal slotted cage may be a singular element formed using additive manufacturing processes such as 3D printing.

The proximal end face of the specific gravity seat 72 impinges and seals on the internal square abutment on the inner surface of the specific gravity closed cage 70. The area bound by the contact line between the specific gravity element 71 and the specific gravity seat 72 forms the sealed distal terminal end of the activation chamber D. Contact between the distal end face on the specific gravity seat 72 and the proximal end face of the bottom bushing 73 forms a seal with the seat 72 and a seal between the proximal end face of the seat 72 and the distal face of the internal abutment 70*b* on the specific gravity closed cage 70. This seal is closed when the bottom bushing 73 is threadingly engaged with the internal thread 70*c* disposed on the distal end of the specific gravity closed cage 70.

In some embodiments, the assembly comprises a bottom bushing threadingly engaged with the specific gravity closed cage and enveloping a filtration assembly; a filter basket configured to filter and clean the fluid which enters the internal cavities of the actuator; a lock bushing, threaded into the bottom bushing, which secures the filter basket and pre-loads a filter spring to retain the filter basket in place; a filter spring configured to maintain the filter basket in place during all pumping operations.

In some embodiments, the filter basket is secured in place using radially disposed set screws or a retaining ring in place of the lock bushing. In some embodiments, the spring may be a compression coil spring, a wave spring, a disc spring or a flat cantilever spring. In some embodiments, the filter basket may be secured without the use of a spring. In some embodiments, the filter may be constructed of, for example, sintered metal, porous metal fabric, wire wool, or any other suitable materials known to a person skilled in the art. Such filters may be in the form of a basket, disc, cone, cylinder, hemisphere, or any other suitable forms as known to a person skilled in the art.

A locked bushing 74 and filter spring 76 provide secure placement for the intake filter basket 75. The intake filter basket 75 separates solids from the fluid entering the internal cavity of the non-locking actuator assembly 1, to keep solids from entering the non-locking actuator assembly. A resilient washer 111 allows for a make-up torque in connecting the distal inlet/outlet housing to the pressure cylinder. In alternative embodiments, the distal inlet/outlet intake filter comprises strainer cup 110 formed of porous sintered metal, as may be seen in FIG. 11E.

The specific gravity element 71 has a specific gravity which is greater than that of a gas and less than that of a liquid such as oil or water. Preferably, it is a hollow gas-filled metal or plastic sphere which has the desired specific gravity. The sphere should have a suitable combination of wall thickness and internal pressure to prevent it from collapsing when subjected to external fluid pressure. As a result, when the specific gravity element 71 is surround by gas, it will sink to the distal end of the cage 70 and seat on specific gravity seat 72, thereby sealing the distal end of the activation chamber D. When the specific gravity element is surrounded by a liquid, it will rise to the proximal end of the specific gravity cage 70, and flow is permitted through the specific gravity cage 70, around the specific gravity element 71.

The specific gravity element may be, for example, a hollow thin-walled sphere built from titanium. In other embodiments, the specific gravity element may be of a shape other than a hollow, thin-walled sphere. In some embodiments, the hollow specific gravity element may be internally pressurized. The hollow, spherical specific gravity element may be manufactured with a static internal pressure exceeding one atmosphere to reduce operating stresses in its wall and enhance its operating life. In some embodiments, the hollow specific gravity element may be manufactured from steel, aluminum, carbon fiber, fiberglass, polymer, or thermoplastic or any combination thereof.

The specific gravity element 71 activates the non-locking actuator assembly when gas is present in the pump barrel 303 and the activation chamber D, causing the specific gravity element 71 to sink downwardly in direction X, thereby settling on and forming a seal with the mating face of the specific gravity seat 72. The gas is thus isolated inside the activation chamber D by the check valve and the specific gravity element 71 seal.

When the traveling assembly moves upward, the gas within the pump barrel expands and reduces in pressure, while the pressure in the activation chamber D remains constant. This divergence is illustrated in FIG. 18A, at the start of the upstroke. This pressure differential urges the bias piston 60 proximally, overcoming the force of return spring 42. The bias piston 60 and therefore the prong 31 is forced upwards in direction Y until it contacts and unseats the traveling valve ball 412, as shown in FIG. 7B. This unseating happens during the upstroke. When the traveling valve ball unseats, fluid in the production tubing 201 above the pump will flow downward, around the traveling valve ball 412, through the ported seat plug 30 flow ports and into the pump barrel 303. Thus, the pump barrel will fill with and be primed by high-quality incompressible fluids.

As the tubing 201 and pump barrel 303 pressures equalize, the pressure difference across the bias piston 60 approaches zero and the return spring 42 urges the bias piston 60 and consequently the prong 31 downward in direction X towards its home position. At the same time, with zero pressure differential across the traveling valve 412, 413, the traveling valve stays open for the remainder of the pump downstroke and normal pumping operations may resume on the next pump stroke.

The return of the bias piston 60 back to its home, non-actuated position, is facilitated by production liquid flowing from the pump barrel 303 into the bias piston chamber G and into check valve chamber C. The pressure acting proximally to the check ball 50 communicates from the pump barrel 303 through the radially disposed ports 20*a* in the wall of the intake housing 20 into the open space between the outer surface of the intake manifold 38 and the inner surface of the intake housing 20, and in turn, through the radially disposed ports 92, hollow lock set screws 45, and filter discs 40, and next through the ports M which are radially disposed through the wall of the rod crossover 33. Finally, the pressure enters the check valve chamber C internal to the rod crossover 33 and bounded distally by the check valve assembly 50, 51, 52.

When the specific gravity element 71 is in the proximal position, such as shown in FIG. 8, the specific gravity element 71 is in contact with the internal surface K of the slotted insert within the specific gravity closed cage 70, and filling of the activation chamber D is permitted with liquid and/or gas flowing past the outer surface of the specific gravity element 71 in the space between the inner surface of the specific gravity closed cage 70 and the specific gravity element 71, bounded laterally by the walls of the slotted insert 70*a*. Simultaneously, fluid in chamber C, which is open to the pressure in the pump barrel, creates a pressure difference which acts on the proximal end of the check ball 50 and, consequently, on the check spring 52, forcing the check ball 50 off its seat (51) and causing the activation chamber D to fill from the proximal end of the assembly as well as from the distal, terminal filtered intake.

Fluid inside the activation chamber D flows outward through the terminal, filtered inlet/outlet by the same passage through which it fills, in between the outer surface of the specific gravity element 71 and the inner surface of the specific gravity closed cage 70. This is facilitated by the buoyancy of the specific gravity element 71 in fluid which keeps it off seat while the chamber empties. The potential for gas lock in the chamber as it empties is prevented by the check valve assembly 50, 51, 52 since it will not permit differential pressure favoring the pump barrel 303 to persist between the pump barrel 303 and the activation chamber D.

Figure 12A:
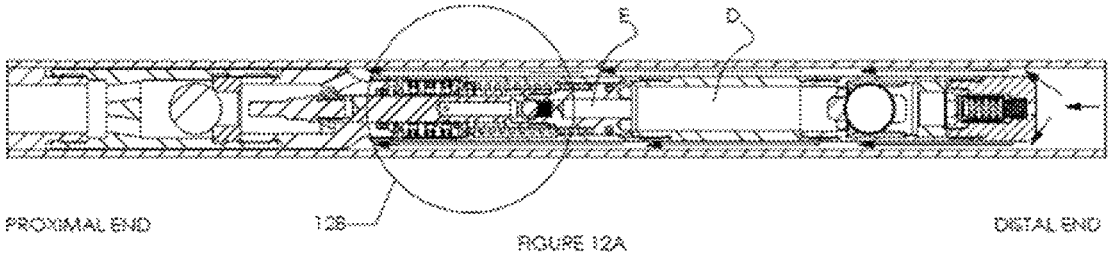
FIG. 12A is a longitudinal cross section through the non-locking actuator assembly showing flow around the assembly.
Figure 12B:
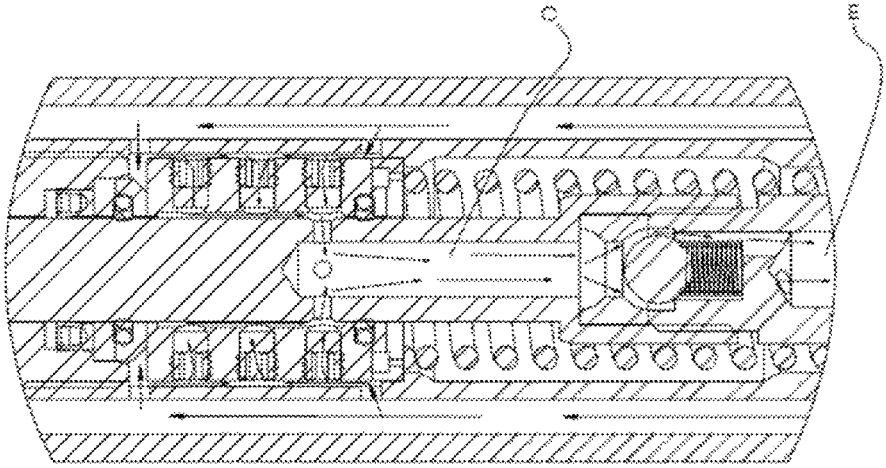
FIG. 12B is a detail view of the actuator section in FIG. 12A showing the flow entering the top of the assembly and passing through the radially disposed ports in the inlet/outlet manifold and through the check valve as the system fills with production fluid.

FIGS. 12A and 12B show fluid or gas flow from the pump barrel region B through filtered lateral ports 92, and into internal chamber region C, and in turn through the check valve to fill the proximal region E of activation chamber D. This flow happens during normal pumping operation. and on the first downstroke when gas occupies the pump barrel.

Figure 13A:
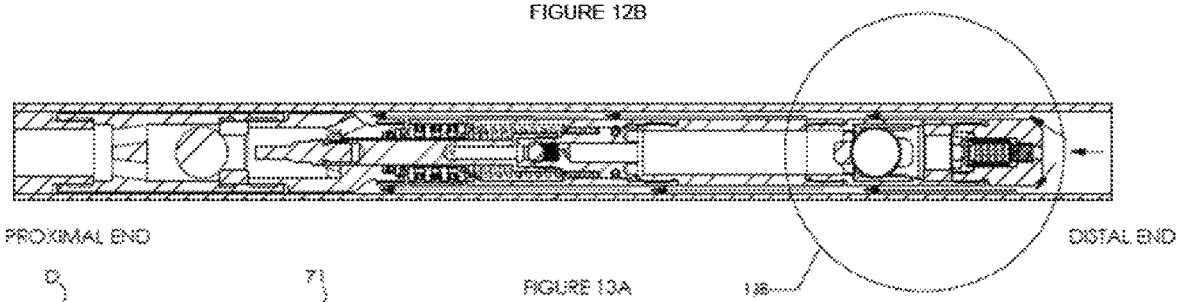
FIG. 13A is the same longitudinal cross section through the non-locking actuator showing flow around the assembly as is shown in FIG. 12A but with a detail view circle surrounding the specific gravity inlet/outlet assembly.
Figure 13B:
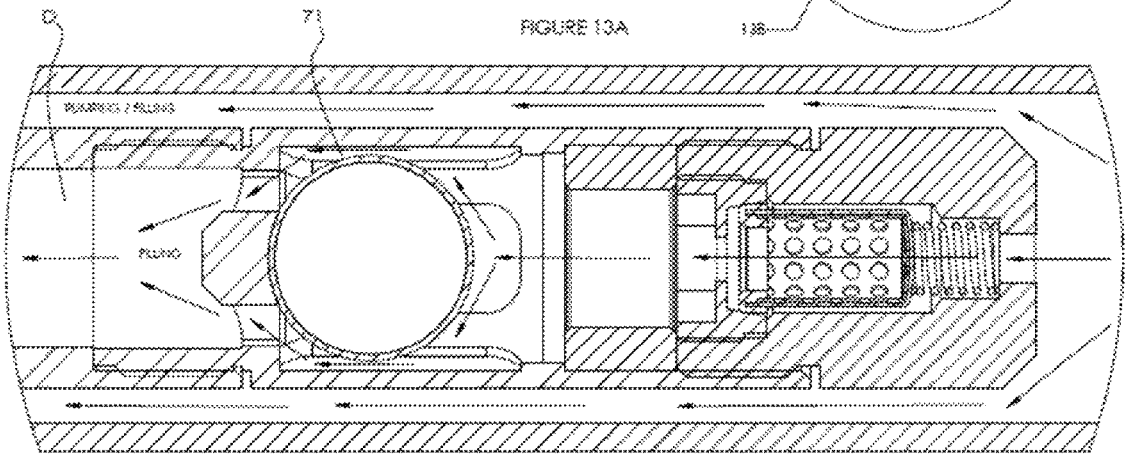
FIG. 13B is a detail view from FIG. 13A depicting the flow paths through the specific gravity inlet/outlet assembly as the tool fills with the fluid/gas from the internal volume of the pump barrel surrounding the non-locking actuator assembly.

FIGS. 13A and 13B show fluid or gas flow from the pump barrel region around the non-locking actuator 1, and upwards through the intake filter basket 75 and into the specific gravity closed cage 70. If this fluid is primarily liquid or has a specific gravity greater than the specific gravity element, the specific gravity element 71 will be in a proximal position, permitting flow around the element and through the cage 70. This flow happens during normal pumping operation, and on the first downstroke when gas occupies the pump barrel.

Figure 14A:
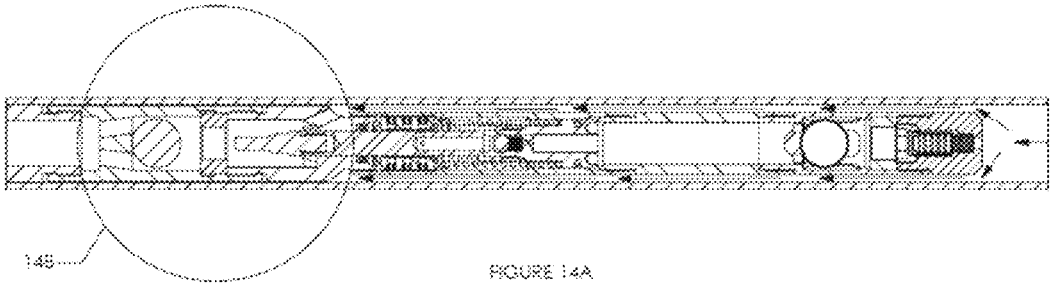
FIG. 14A is a longitudinal cross section through the non-locking actuator with flow of production fluid around the tool and the actuator in the pumping state.
Figure 14B:
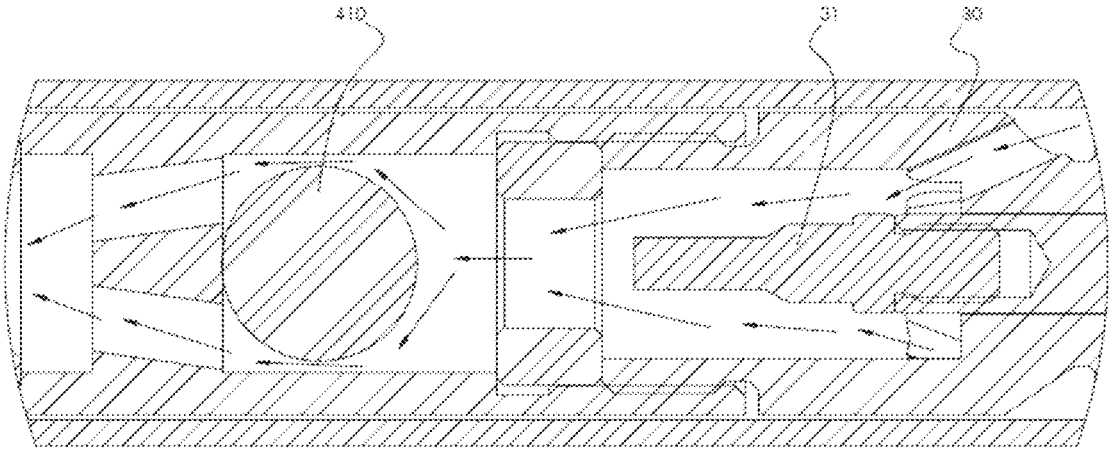
FIG. 14B is a detail view showing the region of the assembly including the ported seat plug and traveling valve in which the arrows depict the flow of production fluid through the assembly during a pump downstroke through incompressible fluids.

In a normal downstroke, high-quality liquids in the pump barrel flow around the non-locking actuator, through the ported seat plug 30 and through the traveling valve, as shown in FIGS. 14A and 14B. It enters the production tubing and is lifted towards the surface on the next upstroke. As the pump plunger assembly travels upward in direction Y, with the traveling valve 410 closed, it lifts the volume of liquid through which it previously descended. The pressure present in the pump barrel (Pbbl) at this point in the pump stroke is equivalent to the pump intake pressure (PIP). This PIP persists in the pump barrel until the traveling assembly begins the next downstroke, at which point the pump stroke operation repeats.

Figure 15A:
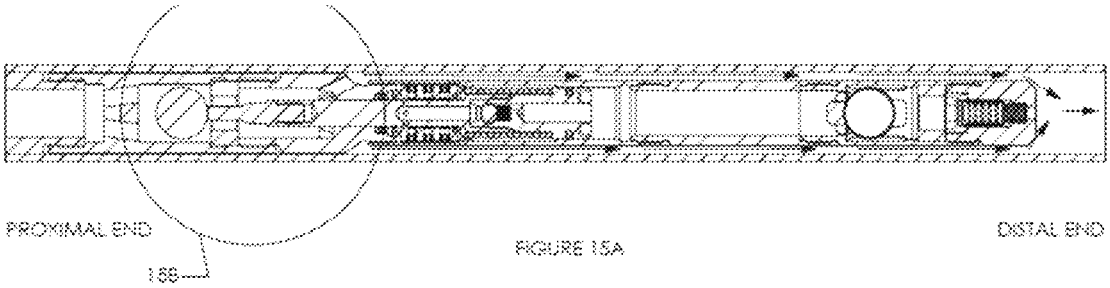
FIG. 15A is a longitudinal transverse cross section through the non-locking actuator assembly in the priming state with production fluid flowing around the tool from the tubing above the actuator to the pump barrel below, wherein the actuator has been activated to unseat the traveling valve ball and prime the pump barrel.
Figure 15B:
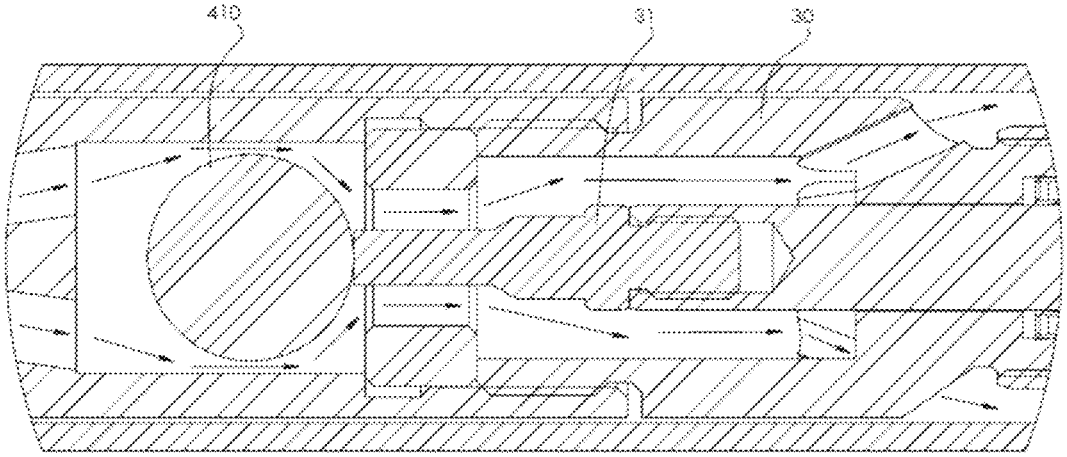
FIG. 15B is a detail view of the same actuator in the priming state which reveals the flow of production fluid around the traveling valve ball, between the prong outer surface and the inner surface of the valve seat, between the inner surface of the ported seat plug and the outer surface of the rod assembly and exiting through the ports in the ported seat plug and into the pump barrel below.

As described above, when the fluid in the pump barrel becomes predominantly gas, pump operation changes substantially. The isolated internal pressure within the activation chamber, now sealed by the specific gravity element 71 moving distally and seating, urges the prong 31 upwards such that when the traveling assembly reaches the top of its upstroke, the ball is unseated, as shown in FIGS. 15A and 15B. High-quality liquids in the production tubing above the traveling valve flows downward around the unseated traveling ball valve to fill and prime the pump barrel.

Figure 16A:
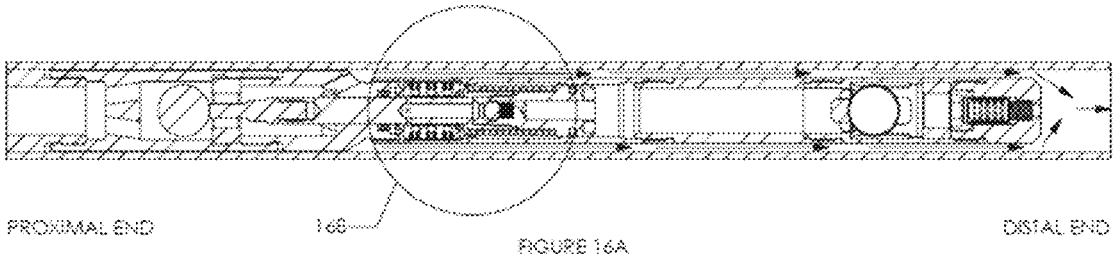
FIG. 16A is a longitudinal cross section through the same non-locking actuator in the priming state with production fluid flowing around the tool from the ports through the ported seat plug and passing around the actuator and into the pump barrel below.
Figure 16B:
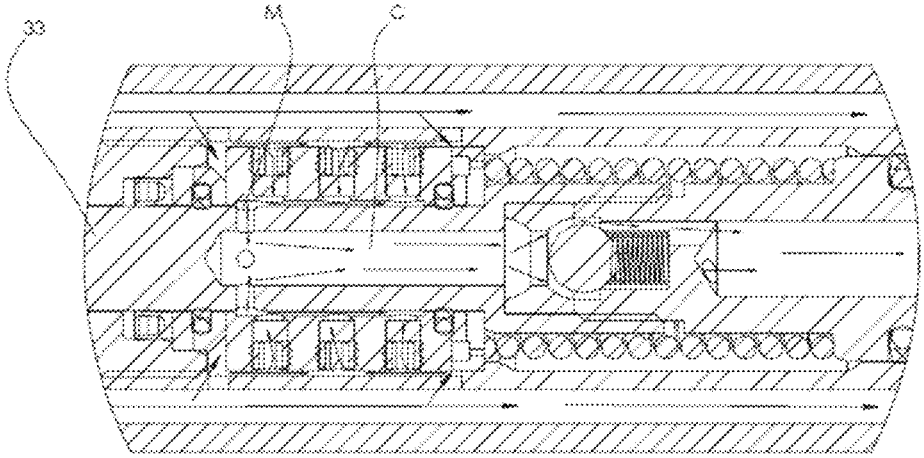
FIG. 16B is a detail view of the same actuator depicting the flow through the actuator internals as the pressure equalizes across the check valve assembly and therefore with the internal cavities of the actuator.
Figure 17A:
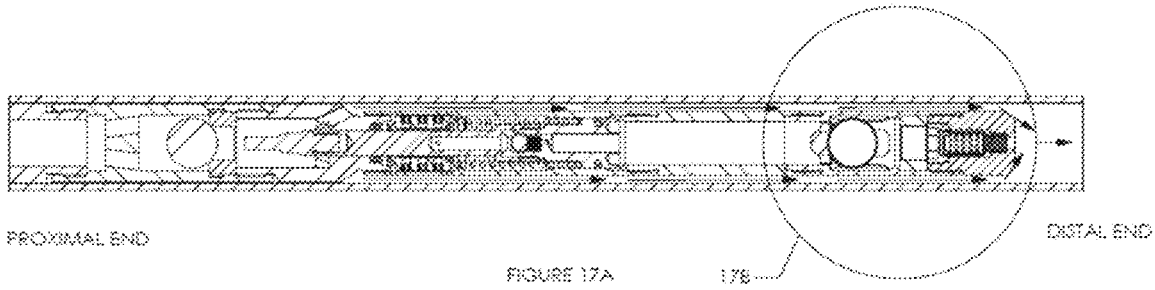
FIG. 17A is a longitudinal cross section through the non-locking actuator with flow around the actuator originating in the tubing above the pump and passing into the pump barrel below.
Figure 17B:
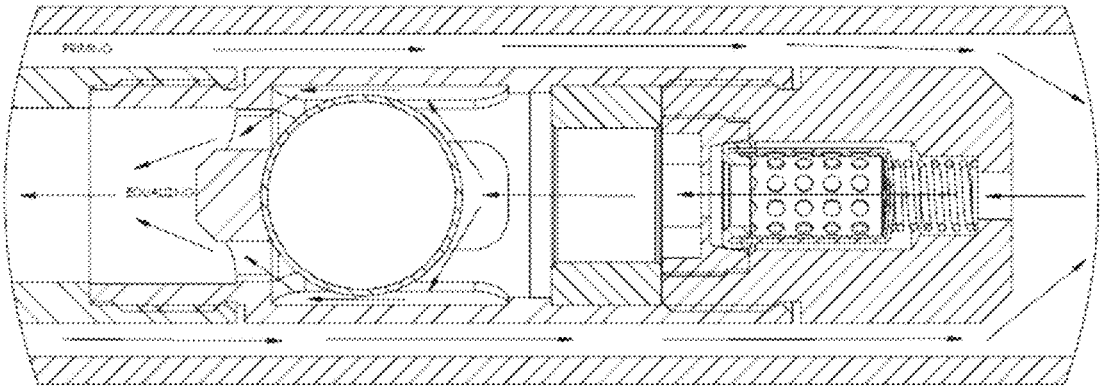
FIG. 17B is a detail view of the specific gravity inlet/outlet section of the actuator depicting the flow into the assembly and around the specific gravity element as the pressures equalize across the actuator during the pump barrel priming state.

FIGS. 16A and 16B illustrate fluid flow at the proximal end of the non-locking actuator when liquid flow primes the pump barrel. At this point, the pressure in the pump barrel Pbbl overcomes the check valve resistance and opens the check valve. As a result, fluid flows into the non-locking actuator through ports 92, 91, 90. At the same time, at the distal end, the specific gravity element 71 will move proximally, as shown in FIGS. 17A and 17B, thereby opening flow through the specific gravity cage and allowing pressure to equalize from the distal end of the non-locking actuator as well as the proximal end.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A non-locking actuator system, for attachment to a traveling valve and disposed within a pump barrel defining a pump barrel volume, comprising:

(a) a ported seat plug configured to attach to a distal end of a traveling valve cage, and defining a port allowing fluid communication from the pump barrel volume to a central chamber which is open to the traveling valve when attached to the traveling valve;

(b) an intake section having a housing attached to a distal end of the ported seat plug and defining an interior volume, the intake housing defining at least one radial port for allowing fluid communication from the pump barrel volume into the non-locking actuator;

(c) a pressure cylinder attached to a distal end of the intake housing and defining an internal activation chamber;

(d) a distal inlet/outlet assembly connected to a distal end of the pressure cylinder and having a specific gravity valve closing a distal end of the activation chamber, the specific gravity valve comprising a specific gravity element having a specific gravity between that of a gas and a liquid, such that the specific gravity element sinks in a gas and floats on a liquid, thus moveable between an open position when a liquid is present in the assembly and a closed position when a gas is present in the assembly;

(e) a reciprocating actuator assembly comprising a prong having a proximal end disposed in the ported seat plug central chamber and a distal end connected to a rod crossover which extends distally into the intake housing;

(f) an intake manifold disposed within the intake housing, defining a fluid flowpath from the at least one radial port into a check valve chamber formed within a distal end of the rod crossover;

(g) a check valve permitting fluid flow from the check valve chamber to the activation chamber when the check valve is open, but which does not permit fluid flow from the activation chamber to the check valve chamber; and (h) a bias piston attached to a distal end of the rod crossover and sealed to an inner surface of the pressure cylinder, wherein the bias piston is responsive to a pressure differential between the pump barrel volume and the activation chamber, to move between a non-actuated distal position and an actuated proximal position, wherein the bias piston is biased into the non-actuated position, and wherein the bias piston moves the prong proximally to impinge on a traveling valve ball to unseat the traveling valve ball when in the actuated position.

2. The system of claim 1, wherein the specific gravity element is a hollow gas-filled sphere.

3. The system of claim 2 wherein the hollow gas-filled sphere is made from titanium.

4. The system of claim 2 wherein the sphere is pressurized above atmospheric pressure.

5. The system of claim 1 wherein the inlet/outlet assembly comprises a filter cage and a filter element, for filtering fluids entering the non-locking actuator.

6. The system of claim 1 wherein the intake manifold assembly comprises a filter cage and a filter element, for filtering fluids entering the non-locking actuator.

7. The system of claim 6 wherein the filter element comprises a porous sintered metal cup.

8. The system of claim 6 wherein the filter element comprises a porous sintered metal disc.

9. The system of claim 6 wherein the filter element comprises a porous sintered metal tube.

10. The system of claim 1 wherein the rod crossover is sealed to an interior surface of the ported seat plug with a solid wiper ring seal or a seal gland comprising a stationary seal and a split wiper ring.

11. A non-locking actuator configured to connect to a distal end of a traveling assembly, and disposed within a pump barrel defining a pump barrel volume, the actuator comprising a ported seat plug, an intake section connected to a distal end of the ported seat plug and comprising an intake manifold open to the pump barrel volume, an actuator section having a pressure cylinder and connected to a distal end of the intake section and comprising a bias piston sealed within the pressure cylinder, an activation chamber formed within the pressure cylinder by a distal inlet/outlet valve and a distal surface of the bias piston, with a check valve disposed at a proximal end of the bias piston, and a reciprocating actuation assembly connected to the bias piston and comprising a prong disposed within the ported seat plug for impinging on a traveling valve ball when in an actuated position, the non-locking actuator defining:

a. A first internal bi-directional flowpath from the pump barrel volume into the traveling valve assembly through the ported seat plug, wherein the first flowpath is always open;

b. A second equalization flowpath from the pump barrel volume through the intake manifold and into a check valve chamber formed proximally of the check valve, and unidirectionally into the activation chamber through the check valve;

c. A third internal bi-directional flowpath from the pump barrel volume into the activation chamber through the distal inlet/outlet valve;

d. wherein the distal inlet/outlet valve comprises a specific gravity element responsive to the density of fluid in the inlet/outlet valve;

e. wherein the second and/or third flowpaths are open to the activation chamber when pressure in the pump barrel volume is greater than the activation chamber pressure; and f. wherein the third flowpath is open to the activation chamber when the specific gravity of the fluid in the inlet/outlet valve is greater than that of the specific gravity element and is closed when the specific gravity of the fluid in the inlet/outlet valve is less than that of the specific gravity element.

12. A method of operating a reciprocating rod pump positioned non-horizontally, the rod pump having a traveling valve and a pump barrel, comprising the steps of:

a. Providing a non-locking actuator having a reciprocating actuation assembly for impinging on a traveling valve ball to open the traveling valve when a gas dominates in the pump barrel, and installing the non-locking actuator on a traveling assembly of the reciprocating rod pump;

b. When a gas dominates in the pump barrel, creating a sealed activation chamber within the non-locking actuator, having a pressure equal to the pump barrel pressure at the end of a downstroke;

c. Automatically and passively activating the reciprocating actuation assembly to open the traveling valve, by a pressure differential between the activation chamber pressure and the pump barrel pressure during the next upstroke; and d. Priming the pump barrel with liquids passing downward through the open traveling valve.

13. The method of claim 12 wherein the sealed activation chamber is created with a specific gravity element having a specific gravity intermediate that of a liquid and of a gas, moveable within a specific gravity valve to close when the specific gravity valve is filled with a gas.

14. The method of claim 13 wherein the specific gravity element is a hollow sphere.

15. The method of claim 14 wherein the hollow thin walled sphere is built from titanium.

16. The method of claim 15 wherein the hollow sphere is pressurized above atmospheric pressure.

17. The method of claim 12 further comprising the step of equalizing pressure in the activation chamber and in the pump barrel through either or both a proximal or distal end of the activation chamber, during or after the pump barrel has been primed with liquid.

* * * * *